US007616922B2

(12) United States Patent
Yoshino et al.

(10) Patent No.: US 7,616,922 B2
(45) Date of Patent: Nov. 10, 2009

(54) CLEANING DEVICE FOR CLEANING A SURFACE OF AN IMAGE FORMING APPARATUS, IMAGE FORMING APPARATUS, AND PROCESS CARTRIDGE

(75) Inventors: Kaoru Yoshino, Tokyo (JP); Takeshi Shintani, Kanagawa (JP); Junya Takigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 452 days.

(21) Appl. No.: 11/469,143

(22) Filed: Aug. 31, 2006

(65) Prior Publication Data

US 2007/0071525 A1 Mar. 29, 2007

(30) Foreign Application Priority Data

Sep. 28, 2005 (JP) ..... 2005-281533

(51) Int. Cl.
*G03G 21/00* (2006.01)

(52) U.S. Cl. ..... 399/346; 399/349

(58) Field of Classification Search ..... 399/346, 399/349, 353

See application file for complete search history.

(56) References Cited

U.S. PATENT DOCUMENTS

| | | | | |
|---|---|---|---|---|
| 7,228,099 | B2 * | 6/2007 | Shintani et al. | 399/346 |
| 7,313,347 | B2 * | 12/2007 | Shintani et al. | 399/353 |
| 2005/0002705 | A1 | 1/2005 | Shintani et al. | |
| 2006/0039726 | A1 | 2/2006 | Shintani et al. | |

FOREIGN PATENT DOCUMENTS

| | | |
|---|---|---|
| JP | 6-236134 | 8/1994 |
| JP | 07-155222 | 6/1995 |
| JP | 8-160819 | 6/1996 |
| JP | 10-282854 | 10/1998 |
| JP | 11-212398 | 8/1999 |
| JP | 2001-235987 | 8/2001 |
| JP | 2002-287592 | 10/2002 |
| JP | 2004-325823 | 11/2004 |

OTHER PUBLICATIONS

U.S. Appl. No. 12/253,581, filed Oct. 17, 2008, Shintani, et al.
U.S. Appl. No. 11/685,660, filed Mar. 13, 2007, Shintani, et al.
U.S. Appl. No. 12/167,564, filed Jul. 3, 2008, Hatori, et al.
U.S. Appl. No. 11/855,353, filed Sep. 14, 2007, Shintani, et al.

* cited by examiner

*Primary Examiner*—William J Royer
(74) *Attorney, Agent, or Firm*—Oblon, Spivak, McClelland, Maier & Neustadt, L.L.P.

(57) ABSTRACT

A cleaning device that cleans the surface of an image carrier, includes a cleaning blade that contacts the surface of the image carrier, a lubricant-applying brush roller that applies a lubricant to the surface of the image carrier, a cleaning brush roller that removes residual transfer toner from the surface of the image carrier, and a flicker that removes toner from the cleaning brush roller. The flicker performs a flicking operation corresponding to a part of the entire area in the axial direction of the cleaning brush roller at one time. A process cartridge and an image forming apparatus include the image carrier and the cleaning device.

8 Claims, 10 Drawing Sheets

CLEANING DEVICE FOR CLEANING A SURFACE OF AN IMAGE FORMING APPARATUS, IMAGE FORMING APPARATUS, AND PROCESS CARTRIDGE

CROSS-REFERENCE TO RELATED APPLICATIONS

The present document incorporates by reference the entire contents of Japanese priority document, 2005-281533 filed in Japan on Sep. 28, 2005.

BACKGROUND OF THE INVENTION

1. Field of the Invention

The present invention relates to a cleaning device, and an image forming apparatus and a process cartridge that include the cleaning device.

2. Description of the Related Art

In general, an image forming apparatus using an electrophotography process includes a photosensitive material as an image carrier. Electric charge is applied through discharge to the surface of the photosensitive material for charging the photosensitive material, and the charged surface of the photosensitive material is exposed to form an electrostatic latent image. This latent image is then supplied with toner to be a visible image. The visible image formed on the surface of the photosensitive material is transferred and fixed onto the surface of transfer paper. The transfer paper with the visible image is delivered outside the image forming apparatus.

The photosensitive material after transfer of the visible image has untransferred toner and other substances left on its surface. Therefore, to prevent these substances from affecting the next image formation, the surface of the photosensitive material after transfer is cleaned by a cleaning device for preparing for the next image formation process. An example of such a cleaning device generally known is the one in which a cleaning blade formed of an elastic body, such as rubber, slidably scrubs the surface of the photosensitive material to remove attachments, such as untransferred toner.

However, with such a configuration of the cleaning blade that removes attachments with a blade in a mechanical manner, the residue tends to be accumulated between the surface of the photosensitive material and the tip of the blade making contact with the surface of the photosensitive material. Therefore, when the next untransferred toner is delivered with a certain amount of residue accumulated therebetween, a cleaning failure tends to occur, in which the untransferred toner goes through as it is without being scraped by the blade.

Also, in recent years, with increasing demands for high image quality and high definition of images, toner made of round particles with a small particle diameter has been used in a developing process. With the use of such toner, the toner can be closely attached to an electrostatic latent image, thereby achieving high image quality and high definition.

However, such toner made of round particles with a small particle diameter tends to go through the cleaning blade in a cleaning process, thereby posing a problem of a cleaning failure. Moreover, since the surface of the photosensitive material wears out, the life of the photosensitive material is shortened.

To get around the problems and solve inconveniences, such as abrasion of a cleaning member and the photosensitive material, a scheme has been taken in which a lubricant is applied onto the surface of the photosensitive material, for example, to reduce a friction resistance between the photosensitive material and the cleaning member. Also, if a lubricant is applied onto the surface of the photosensitive material, a friction resistance on the surface of the photosensitive material can be reduced. Therefore, an effect of preventing the occurrence of so-called filming can be obtained. Filming is a phenomenon in which a superplasticizing agent, a charge-controlling agent, and other agents added to the toner are fixed onto the surface of the photosensitive material due to abutting pressure of the cleaning member, thereby forming a film. Furthermore, since the attachment force of the toner developed on the photosensitive material is also reduced with respect to the photosensitive material, transferability is increased.

Examples of a unit for applying a lubricant onto the surface of the photosensitive material include one with a solid lubricant formed of, for example, fatty acid metallic salt, in a stick-like shape, and a brush roller having brush bristles the tips of which contact both of the solid lubricant and the photosensitive material. With such an applying unit, when the brush roller is rotatingly driven, the solid lubricant is shaved through a sliding scrub by the rotatingly-driven brush roller to become powder. This powder-like solid lubricant is then attached to fibers of brush bristles of the brush roller. Next, the powder-like lubricant attached to the brush roller is applied onto the surface of the photosensitive material positioned downstream of a rotating direction.

To efficiently function this applying brush roller for applying the lubricant onto the surface of the photosensitive material, in some cases, a cleaning brush roller is provided on an upstream side of the applying brush roller, the cleaning brush roller for scraping untransferred toner and other substances off the surface of the photosensitive material. Since untransferred toner is attached to the surface (brush bristles) of the cleaning brush roller, a flicker is fixedly arranged to contact the cleaning brush roller. With this flicker, the attached toner on the cleaning brush roller is scraped off to a waste toner path.

In this manner, in recent years, one scheme has been adopted as a scheme of cleaning the photosensitive material in which two brush rollers, one for additional cleaning and the other for applying a lubricant are provided to increase cleaning ability.

An example of an image forming apparatus adopting the scheme described above is the one including: a cleaning aid unit that partially removes attachments on a latent-image carrier; a lubricant applying unit provided at a downstream side of the cleaning aid unit in a direction of delivering a transfer material, the lubricant applying unit applying a lubricant on the surface of the latent-image carrier; and a cleaning blade provided at a downstream side of the lubricant applying unit in the direction of delivering the transfer material, the cleaning blade scraping residual toner off the latent-image carrier (for example, refer to Japanese Patent Application Laid-Open No. 2004-325823 (pp. 1-2, FIG. 1)). Therefore, according to this image forming apparatus, transfer unevenness due to a cleaning failure can be prevented, thereby achieving high image quality. That is, with the cleaning aid unit, part of the attachments are first removed from the latent-image carrier, and then, with the lubricant applying unit, the lubricant is applied onto the surface of the latent-image carrier. Therefore, the lubricant can be applied evenly. For this reason, friction between the surface and the tip of the blade can be kept constant. As a result, the residual attachments can be reliably scraped by the cleaning blade, thereby preventing the attachments from being accumulated.

Also, a cleaning device has been known that is configured to include: a bristle brush roll having a perimeter surface provided with a bristle brush portion with a loop-pile-shaped filling structure, the bristle brush portion formed with a spiral groove portion; and a cleaning blade abutting on an image carrier, such as a photosensitive drum, wherein the bristle brush roll scrapes a developing agent remaining on the photosensitive drum through rotation of the bristle brush roll, the scraped developing agent is delivered along the groove portion in an axial direction, and the cleaning blade scrapes and removes the residual developing agent that was unable to be removed by the bristle brush roll (for example, refer to Japanese Patent Application Laid-Open No. H8-160819 (pp. 2-4, FIGS. 1 and 2)). Therefore, according to the cleaning device, with the loop-pile-shaped filling structure of the bristle brush portion, loss of bristles can be prevented. Also, a situation can be prevented such that a lost bristle is inserted between the cleaning blade and the image carrier, thereby preventing the image carrier to be damaged and also preventing the occurrence of a cleaning failure. Still further, with the spiral groove on the bristle brush portion, the scraped developing agent can be delivered. Therefore, unlike the conventional technology, no mechanism for delivering the developing agent is required, thereby achieving a reduction in configuration.

Furthermore, an image forming apparatus using an image forming method has been known in which, after the image carrier is charged and image-exposed to light to form an electrostatic latent image, the image is made visible by a developing agent, and then undergoes transfer and cleaning processes for image formation, the image forming apparatus including a lubricant applying device that evenly applies a lubricant made of lubricating oil or lubricating grease onto the image carrier to form a thin film, with the use of a brush-shaped rotating body arranged to contact the image carrier, and an application amount controlling device that controls the amount of application of the lubricant (for example, refer to Japanese Patent Application Laid-Open No. H11-212398 (pp. 2-4, FIGS. 3 to 5)). Therefore, according to this image forming apparatus, the amount of reduction in film thickness of a photosensitive layer can be suppressed as much as possible, squeak noise of the blade can be eliminated, and images with high resolution can be kept for a long time. That is, in the conventional configuration, merely applying the lubricant produces a thick liquid film without evenness at all and, therefore, toner tends to be attached and images tend to be disturbed. However, in this image forming apparatus, with an applying brush as a brush-shaped rotating body, operations of applying the lubricant onto the brush, evenly spreading the applied lubricant over the surface of the photosensitive material, and polishing can be achieved.

Still further, an image forming apparatus has been known, which includes a cleaning unit that cleans the surface of a moving member, such as a photosensitive material or a transfer belt, with toner attached thereto, wherein the cleaning unit includes a cleaning blade formed of a rubber compact and a cleaning brush rotatably making contact with the surface of the moving member, and a conductive roller that cleans the surface of the moving member, the conductive roller with a predetermined bias being applied thereto, and a low friction portion is provided near an edge of the cleaning blade (for example, refer to Japanese Patent Application Laid-Open No. 2002-287592 (pp. 2-4, FIG. 1)). Also, in this image forming apparatus, the cleaning brush is configured to be conductive and is applied with a bias to electrically remove toner. Furthermore, the brush is rotated to mechanically remove toner. Still further, at least one portion of the cleaning brush is configured to have a portion where brush bristles are formed in a loop. Therefore, according to this image forming apparatus, since a low friction portion is provided near the edge of the cleaning blade, toner that cannot be removed by the cleaning brush can be removed by the cleaning blade. Also, even if the amount of toner onto the cleaning blade is small, the blade does not curl up, thereby keeping an excellent cleaning state. Still further, in a configuration allowing toner removal by the cleaning brush to be performed in an electrical and mechanical manner, more reliable toner removal can be made. In a configuration having loop-shaped brush bristles partially included therein, foreign substances that cannot be removed by the cleaning blade can be removed, thereby ensuring excellent cleaning ability.

Still further, an image-carrier cleaning apparatus has been known which at least includes: a cleaning brush formed in a roll shape that rotates and makes contact with a carrier surface after toner image transfer to slidably scrub the carrier surface; a cleaning blade that is pressed against the carrier surface at a downstream side of the cleaning brush in the movement direction of the carrier surface and scrapes residual toner from the carrier surface; and a flicker member for removing the toner attached to the cleaning brush from the cleaning brush, wherein the flicker member is provided with a solid lubricant, and the solid lubricant is applied onto the carrier surface of the image carrier via the cleaning brush to control a coefficient of friction of the carrier surface of the image carrier (for example, refer to Japanese Patent Application Laid-Open No. 2001-235987 (pp. 4-7, FIG. 1)). Therefore, according to this image-carrier cleaning device, a dedicated holding unit for holding a lubricant is not required. Thus, the conventional cleaning device can be inexpensively achieved almost without being increased in size.

Another image forming apparatus has been known in which a cleaning unit having a brush roller removes toner remaining on an image carrier after transfer, wherein brush bristles forming the brush roller are filled in a direction to form a tilt angle with respect to the direction of the normal to the rotational axis of the brush roller, the brush roller is pressed against the image carrier so that the tilt direction of filling the brush bristles at a position in contact with the brush roller is opposite to a rotating direction of the image carrier at the contact position, and a portion near the tip of the brush bristles is rotated as being pressed against the surface of the image carrier to slidably scrub that surface (for example, refer to Japanese Patent Application Laid-Open No. H10-282854 (pp. 5-11, FIGS. 2 to 4)). Therefore, according to this image forming apparatus, the tips of the brush bristles make contact with the perimeter surface of the image carrier to form an acute angle, thereby removing the developing agent from the image carrier in a scraping manner. Thus, clogging of the developing agent among the brush bristles of the brush roller can be mitigated, thereby keeping stable cleaning ability for a long time and solving an overflow of the developing agent. Also, driven rotation of the brush roller by the rotation of the image carrier is conventionally difficult because of a small coefficient of friction of the surface of the brush roller. By contrast, the brush bristles are filled in a direction opposite to the rotating direction of the image carrier. Therefore, the coefficient of friction of the roller surface is large, thereby allowing driven rotation. Thus, a simple structure without requiring a dedicated driving mechanism can be achieved. Such a structure is effective in saving space and reducing manufacturing cost.

Another cleaning device has been known in which residual toner on a photosensitive material after transfer is removed by a cleaning brush and a cleaning blade, wherein the cleaning brush is configured by winding a band-shaped brush member around a shaft, the brush member is configured by filling four and three fiber bundles each being formed of a bundle of insulating fibers and a bundle of conductive fibers as a unit for every 11 millimeters in a fabric-width direction of a base fabric, the fiber bundles being in W-weave in row, with a space in a width direction of each fiber bundle being set to 2 millimeters to 3 millimeters, a width of W-weave being set to 2 millimeters to 4 millimeters, and a space between three bundles and four bundles being set to 0.5 millimeters to 1.5 millimeters, the width of the base fabric being 30 millimeters, and a pitch of winding around the shaft being set as 1.1 times to 1.4 times wider than the width of the base fabric (for example, refer to Japanese Patent Application Laid-Open No. H6-236134 (pp. 3-5, FIGS. 6 and 7)). Therefore, according to this cleaning device, toner and additives are prevented from being accumulated among the brush fibers of the cleaning brush to harden the brush as a whole. Also, there is no need to reattach the removed additive to the photosensitive material. Thus, the additive on the photosensitive material can be excellently removed without any damage on the photosensitive material.

However, in the conventional configurations described above, a member equivalent to a flicker for cleaning by flicking attachments from the brush bristles of the cleaning brush roller is provided. Due to a flicking operation of this flicker simultaneously occurring over an entire area in a longitudinal direction of the brush roller, there is a problem of decreasing image quality.

That is, in the case where the bristles of the cleaning brush rollers are aligned in a direction parallel to the roller axis, when toner is scraped by the flicker, the brush bristles simultaneously make contact with the flicker over the entire area in the longitudinal direction of the brush roller, and also simultaneously go away from the flicker over the entire area in the longitudinal direction. As such, since making contact and going away are repeated, there is a problem in which the flicker is vigorously vibrated. That is, all brush bristles aligned on a line in the longitudinal direction of the brush roller simultaneously make contact with and go away from the flicker, a timing of occurrence of a reaction force due to a contact of the brush bristles aligned in the roller's longitudinal direction with the flicker is almost the same as a timing of disappearance thereof. Therefore, a large force is intermittently exerted on the flicker at the time of rotation of the brush roller. As a result, the flicker is caused to be vigorously vibrated. In particular, rotation of the brush roller at high velocity causes vibration to be more fierce. In the case of a configuration using loop-shaped brush bristles for increasing toner-removing ability, it is known that energy of vibration is also increased compared with a straight-bristle brush.

Such flicker's vibration is propagated to the photosensitive material, causing rotation unevenness of the photosensitive material (variations in velocity of the photosensitive material). This causes variations in density in a sub-scanning direction called banding to appear on an image, thereby degrading image quality. Such a state is depicted in FIG. 11. The frequency of vibrations is represented by $(CI/P)\times\omega$ Hertz, where the circumference of the cleaning roller is CI millimeters, a filling pitch in a circumferential direction is P millimeters, and the number of rotation is $\omega$ rev/s.

In the configuration disclosed in Japanese Patent Application Laid-Open No. H10-282854, the bristle-filling direction of the cleaning brush roller is regulated. However, what is defined is the tilt angle with respect to the direction of the normal to the rotational axis of the brush roller, and the bristle-alignment direction in a rotational-axis direction of the brush roller is not regulated. Therefore, in a manner similar to that described above, the brush bristles simultaneously make contact with and go away from the image carrier repeatedly over the entire area in the longitudinal direction of the brush roller. Rather, the tilt direction of filling with the brush bristles is set to be opposite to the rotating direction of the image carrier. That is, the brush bristles are tilted forward in a direction in which the brush bristles advance. Thus, when a scraper serving as a flicker makes contact with the brush bristles, the degree of bending the brush bristles is large. Accordingly, the reaction force caused by the brush bristles is increased to cause vibrations of the flicker to be more fierce.

Also, in the configuration disclosed in Japanese Patent Application Laid-Open No. H6-236134, no mention is made to a relationship between a flicker bar serving as a flicker and vibrations, Furthermore, the bristle-alignment direction on the outer perimeter of the brush roller depicted in partial front views of the brush roller in FIGS. 5 and 7 seems to be aligned with the roller's longitudinal direction. That is, various space dimensions, width dimensions, and pitches set as described above result in regularity in which the bristle-alignment direction is aligned with the roller's longitudinal direction. In particular, as clearly depicted in FIG. 7, grouped brush bristles are regarded as being arranged to be spaced a predetermined distance apart from one another in a circumferential direction on the perimeter of the brush roller and be roughly aligned with the roller's longitudinal direction, although in a slightly tilted direction. In the end, according to rotation of the brush roller, the brush bristles simultaneously and intermittently make contact with and go away from the flicker in units of groups.

SUMMARY OF THE INVENTION

It is an object of the present invention to at least partially solve the problems in the conventional technology.

According to an aspect of the present invention, a cleaning device that cleans a surface of an image carrier, includes a cleaning blade configured to contact a surface of the image carrier, a lubricant applying roller that applies a lubricant to the surface of the image carrier, a cleaning brush roller that removes residual toner from the surface of the image carrier, and a flicker that removes toner from the cleaning brush roller, and performs a flicking operation corresponding to a part of an entire area in an axial direction of the cleaning brush roller at one time.

According to another aspect of the present invention, a process cartridge that is detachably attached to an image forming apparatus, includes an image carrier, and the above cleaning device.

According to still another aspect of the present invention, an image forming apparatus includes an image carrier, and the above cleaning device.

According to still another aspect of the present invention, an image forming apparatus includes the above process cartridge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings. In the following description, a cleaning device according to an embodiment is applied to a full-color copier as an image forming apparatus.

Figure 1:
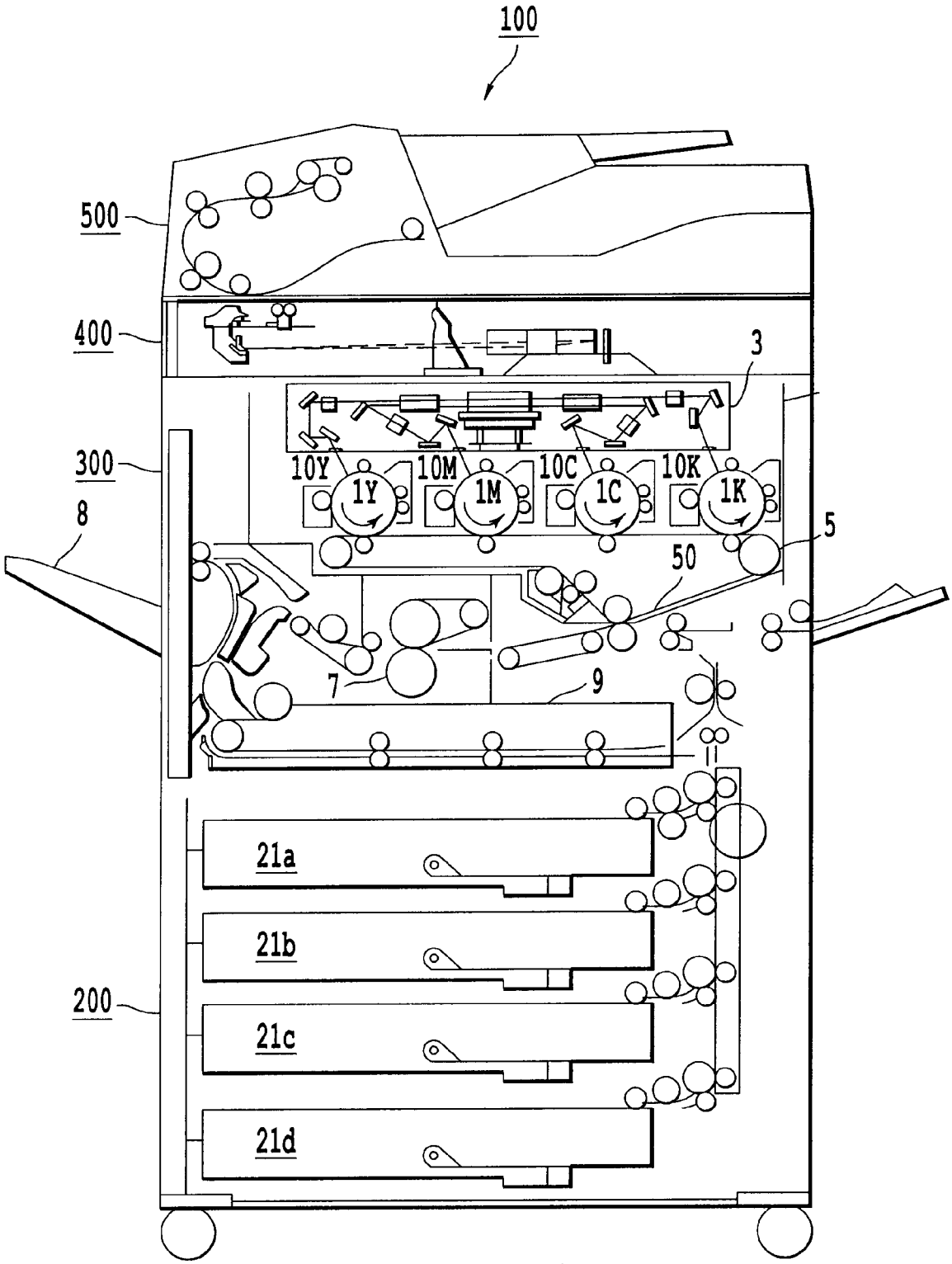
FIG. 1 is a schematic front view of an image forming apparatus that includes a cleaning device according to a first embodiment of the present invention.
Figure 2:
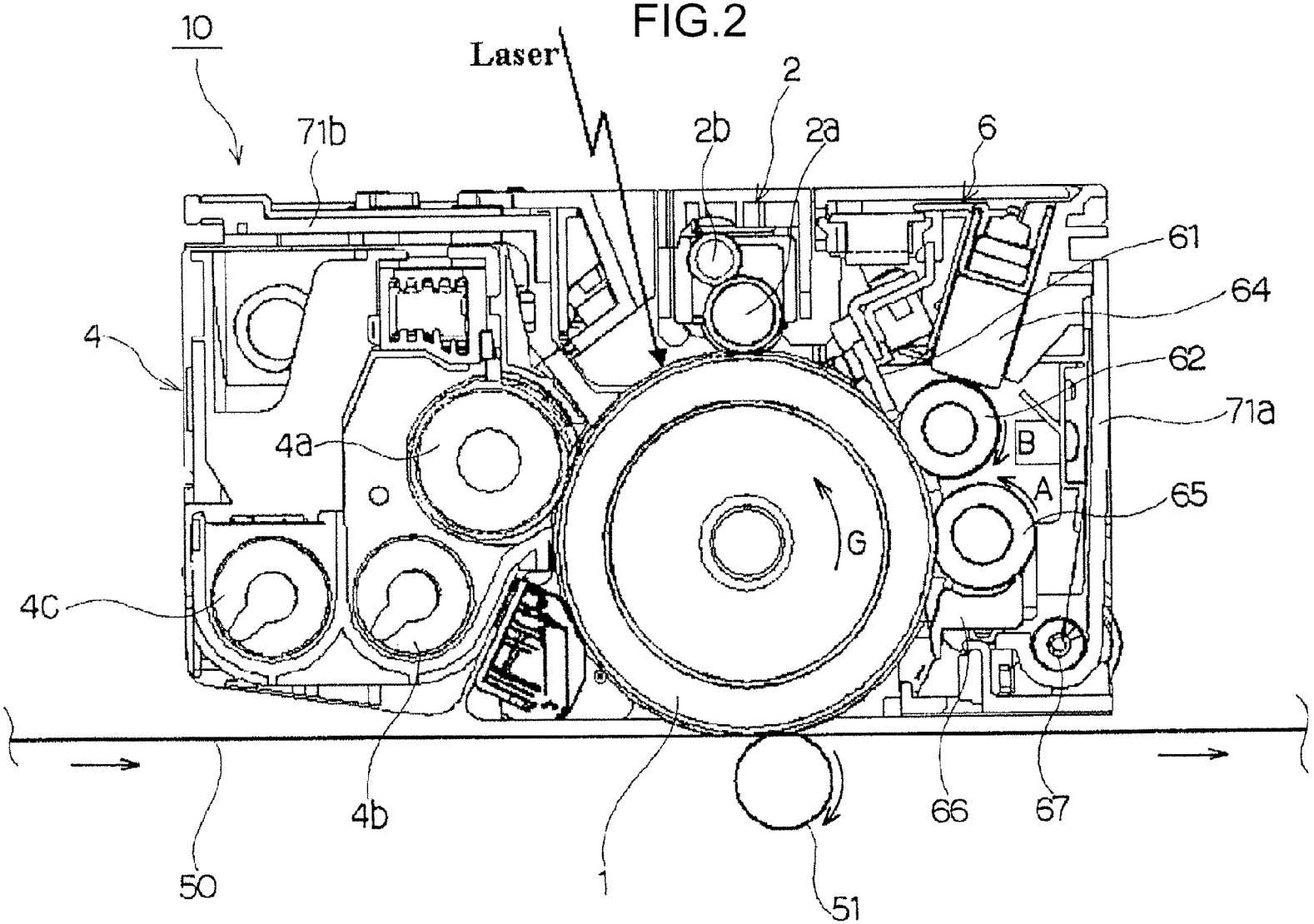
FIG. 2 is a schematic cross-section of an image forming unit as a process cartridge having incorporated therein the cleaning device shown in FIG. 1.
Figure 3A:
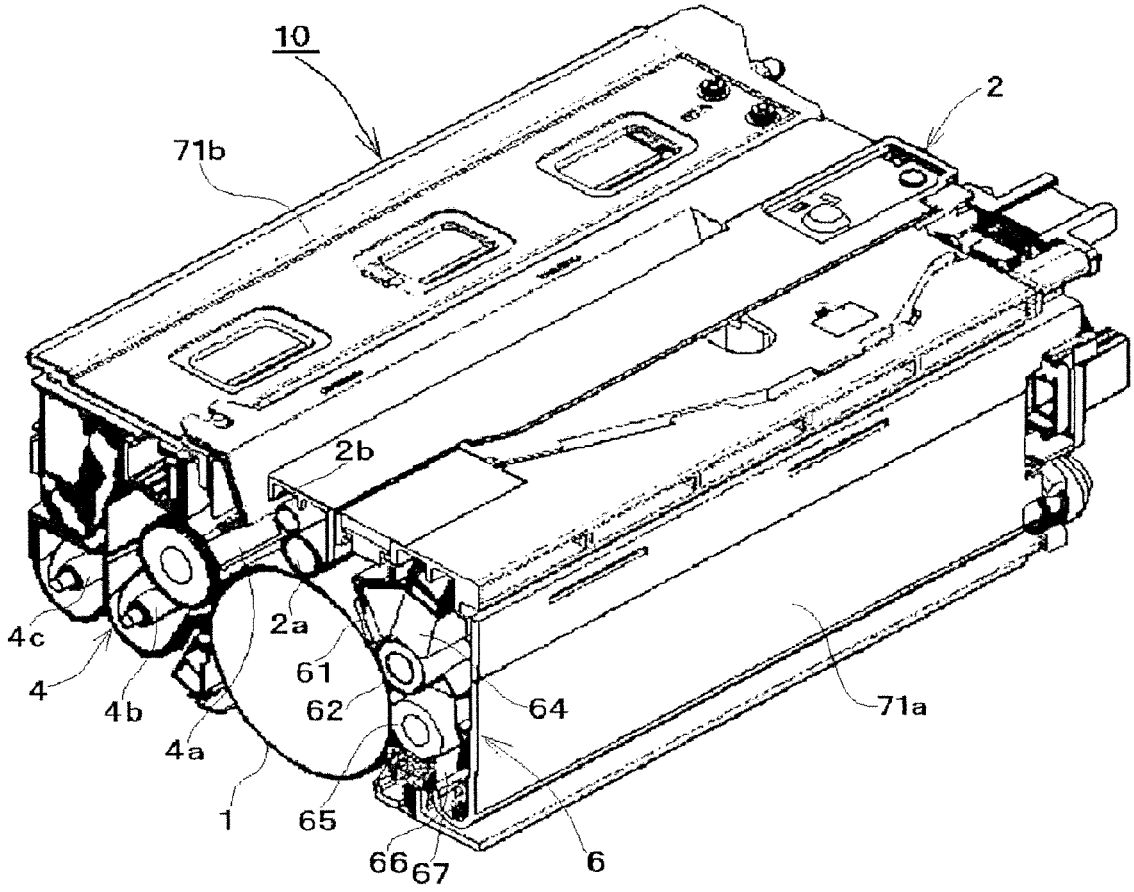
FIG. 3A is a schematic, perspective, partial-cutaway view of the image forming unit shown in FIG. 2.
Figure 3B:
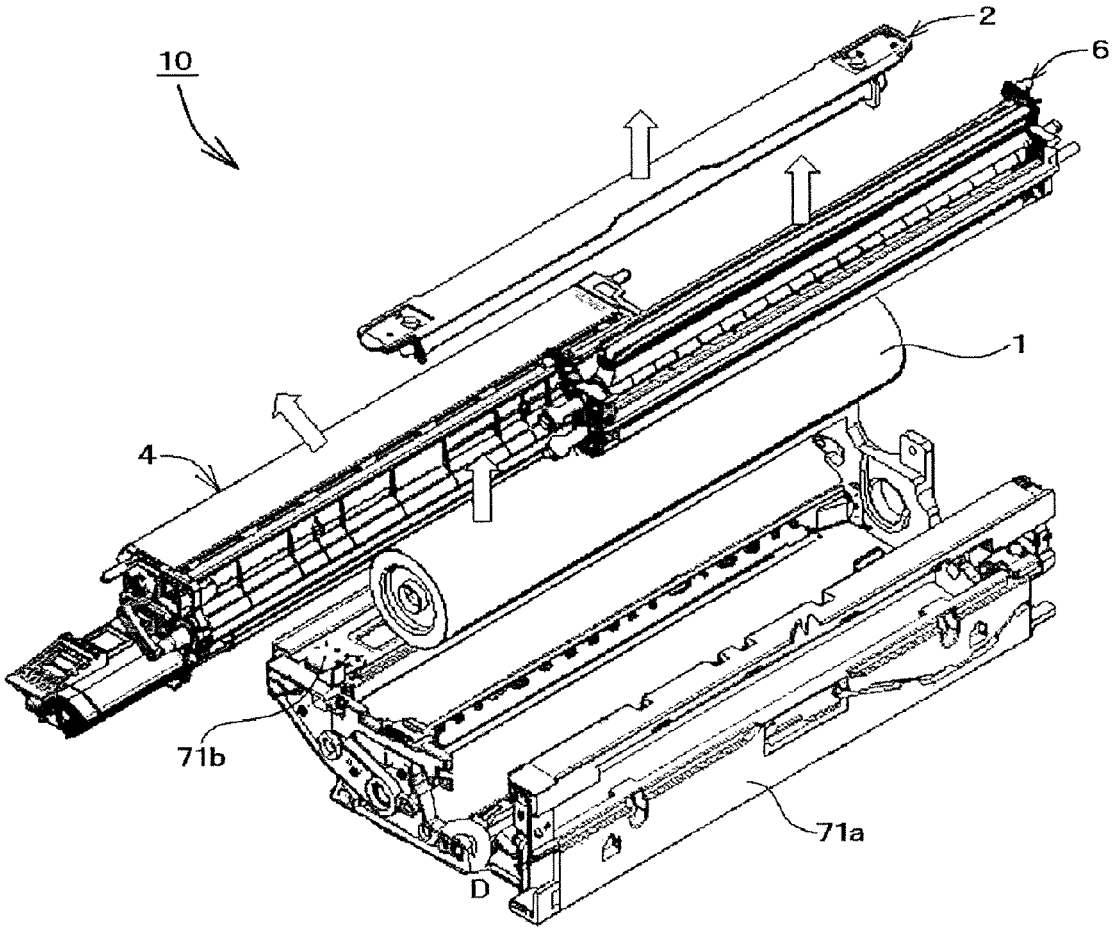
FIG. 3B is a schematic, perspective, broken view of the image forming unit.

FIG. 1 is a schematic front view of a full-color copier 100 as an image forming apparatus that includes a process cartridge with a cleaning device. FIG. 2 is an enlarged cross-section of the process cartridge. FIGS. 3A and 3B are a perspective view and a broken perspective view, respectively, of the process cartridge. The process cartridge can be attached to and detached from the image forming apparatus by a simple operation.

The full-color copier 100 includes a paper feeding part 200, an image forming part 300, a document reading part 400, and an automatic document-conveying part 500 that are sequentially disposed in a vertical direction. Also, with paired conveyer rollers and other paired rollers, a paper-conveying path is formed from the paper feeding part 200 to a paper delivery tray 8 as a delivery unit via a predetermined route.

That is, the paper feeding part 200 accommodates paper-feeding trays 21*a*, 21*b*, 21*c*, and 21*d* formed in a flat-box shape with its upper portion being open and arranged in multiple stages in a vertical direction. Each of the paper-feeding trays 21*a*, 21*b*, 21*c*, and 21*d* accommodates a predetermined number of sheets, not shown, of various sizes multilayered and arranged in a portrait or landscape direction with respect to a paper conveying direction. Also, each of these paper-feeding trays 21*a*, 21*b*, 21*c*, and 21*d* is configured to be able to slidably move to protrude from the paper feeding part 200 to the outside, thereby allowing any one of the paper-feeding trays 21*a*, 21*b*, 21*c*, and 21*d* to be drawn to the outside for paper exchange or paper refill. Furthermore, with those paper-feeding trays 21*a*, 21*b*, 21*c*, and 21*d* of the respective stages, a mechanism in a functional-recovery-routine (FFR) paper-feeding scheme, which is a return-and-separation scheme, is provided. Such an FRR mechanism includes a pick-up roller that makes contact with one end of one of the multilayered sheets that is positioned at the top and then draws the sheet for conveyance, and a separating unit formed of paired rollers, that is, an upper feed roller and a lower reverse roller, for separating the sheet drawn by the pick-up roller as one sheet. Therefore, any one of stages of the paper-feeding trays 21*a*, 21*b*, 21*c*, and 21*d* is first selected, and the multilayered sheets in the selected stage of the paper feeding tray are sequentially drawn one by one from the top for conveyance to the conveying path.

The document reading part 400 has a predetermined range made of contact glass on the upper surface of a reading device body. The reading device body accommodates a reading unit that optically reads an image by scanning a predetermined range on the surface of the contact glass. This reading unit includes a first moving body, a second moving body, an image-forming lens, and a reading sensor. Therefore, when this document reading part 400 performs a reading operation, the first moving body and the second moving body are first moved by a driving mechanism not shown within a predetermined range. Then, the contact glass, that is, a document on the glass, is irradiated with light from a light source of the first moving body, and a reflected light from this document surface is then directed to the second moving body. This reflected light is reflected by a mirror of the second moving body, and is then input to the optical reading sensor via the image-forming lens. As a result, the reading sensor reads an image on the document surface.

Also, in the automatic document conveying part 500, its automatic document conveying unit body itself has a function of a document holding plate and is set on the upper surface of the reading device body. The automatic document conveying unit body is configured to be closed to a close position for covering the upper surface of the contact glass and to be opened to an open position, through manual operations. That is, the automatic document conveying unit body has a lower surface having a shape whose length and width dimensions larger than those of the contact glass, with one end being pivotally supported onto the upper surface of the reading device body with a hinge not shown.

Therefore, to copy a document through a manual operation, the user manually opens the automatic document conveying unit body from a close position to an open position, sets a document on the contact glass of the document reading part 400, and then returns the automatic document conveying unit body to a close position. With this, the automatic document conveying unit body presses all over the document set on the contact glass from the top to flatly expand the document in close contact with the contact glass and also to stably fix the document on the glass. As a result, the surface of the document can be eventually read accurately.

The automatic document conveying unit body includes a document placing tray on which a predetermined number of sheets are placed in a multilayered manner, a document delivery tray on which a predetermined number of sheets of the document read are placed in a multilayered manner, and a conveying path from the document placing tray to the document delivery tray via a document reading position. Therefore, to automatically copy a plurality of sheets of the document, predetermined numbers of sheets of the document placed in a multilayered manner are conveyed one by one to be moved to the document reading position of the document reading part 400. One sheet of the document conveyed is then once stopped at the document reading position and an image on the document surface is read. The document with the image read therefrom is then conveyed to the document delivery tray.

The image forming part 300 mainly includes an image forming section accommodated in an image forming apparatus body, an exposing unit 3, a transfer unit 5, and a fixing unit 7. The paper delivery tray 8 in a predetermined shape, having an area secured for placing a document, is arranged on a side surface of the image forming apparatus to protrude in an approximately diagonally upward direction.

The image forming section includes four process cartridge units 10 (hereinafter, "image forming units") arranged in parallel in an approximately horizontal direction in the image forming apparatus body, each unit being in charge of one of four colors of black (K), cyan (C), magenta (M), and yellow (Y) that is different from one another. These image forming units 10K, 10C, 10M, and 10Y extend for a predetermined length, and are disposed to positions facing an upper surface of a straight-line belt of an intermediate transfer belt 50 tightly stretched in the image forming apparatus body. The image forming units 10K, 10C, 10M, and 10Y are formed so as to be separately and individually removed, as a unit, with ease from each position in the image forming apparatus body. When any one of the image forming units 10 is mounted on the relevant position, an electric system and a driving-force transmitting system are connected to the image forming unit 10 in a predetermined manner in the image forming apparatus body. With this, various electric signals for operation instructions, or power and driving force are supplied from the apparatus body side in a predetermined manner, thereby causing a toner image of the color supported by the image forming unit 10 to be formed in a predetermined manner.

That is, each of the image forming units 10 (10K, 10C, 10M, and 10Y) at least includes a photosensitive member 1, (1Y, 1M, 1C, and 1K) which is an image carrier, a charging unit 2 that charges the surface of the image carrier, and a cleaning device 6 that cleans the surface of the image carrier (the surface of the photosensitive member), and also includes, as appropriate, a developing unit 4 that supplies toner to a latent image formed on the surface of the image carrier for visualization. Furthermore, the exposing unit 3 that writes the latent image on the surface of the charged image carrier through exposure by laser light is disposed near a place where the surface of the image carrier can be irradiated with the laser light.

Specifically, as shown in FIGS. 2, 3A, and 3B, in each of the image forming units 10 (10K, 10C, 10M, and 10Y), the developing unit 4, the charging unit 2, the cleaning device 6, and the photosensitive member 1, which is the image carrier, are supported by process cartridge frames 71*a* and 71*b* so as to be integrated together. As being integrated, the image forming unit 10 can be inserted in and removed from the image forming apparatus body. Also, as shown particularly in FIG. 3B, these components can be disassembled individually. That is, these components can be disassembled by device or section for replacement. Here, in FIGS. 2, 3A, and 3B, the image forming units 10 10K, 10C, 10M, and 10Y for the respective colors have the same configuration. Therefore, each member other than photosensitive members 1K, 1C, 1M, and 1Y is provided with a reference numeral without a suffix of an English capital letter representing the relevant color.

In more detail, the photosensitive members 1K, 1C, 1M, and 1Y each formed in an approximately cylindrical shape are located at the center of the image forming units 10K, 10C, 10M, and 10Y, respectively, with their outer shapes each being formed by the process cartridge frames 71*a* and 71*b* and other exterior members. Each of these photosensitive members 1K, 1C, 1M and 1Y is rotatably supported around a horizontal axis, with its lower portion being exposed to the outside of the imaging forming unit 10. With a rotation driving force being transferred from a driving source, such as a motor, each photosensitive member 1K, 1C, 1M, and 1Y is rotatingly driven at a certain stable velocity in a predetermined rotating direction.

Also, from an upstream side to a downstream side around and in a rotating direction of each of the photosensitive members 1K, 1C, 1M, and 1Y, a static eliminating unit (not shown), the charging unit 2, the developing unit 4, and the cleaning device 6 are sequentially placed, each occupying a predetermined position within a range of one rotation of the relevant one of the photosensitive members 1K, 1C, 1M, and 1Y in a counterclockwise direction. With the static eliminating unit and the charging unit Z, exposing unit 3, and developing unit 4, a static eliminating position, a charging position, a developing position, a transfer position, and a cleaning position are set. Furthermore, between the charging position and the developing position, a latent-image forming position is set. At this latent-image forming position, a rectangular space is formed so as to be irradiated with laser light from the exposing unit 3 outside of the image forming unit 10. With the relevant one of the photosensitive members 1K, 1C, 1M, and 1Y being rotatingly driven in a counterclockwise direction in a predetermined manner, in synchronization with rotation of the relevant one of the photosensitive members 1K, 1C, 1M, and 1Y, each of the charging unit 2, exposing unit 3, and developing unit 4 operates in cooperation with one another in a predetermined manner, thereby performing a series of image forming processes.

That is, the photosensitive member 1 has a surface layer made of amorphous metal, such as amorphous silicon or amorphous selenium with photoconductivity, or an organic compound, such as bis-azo pigments or phthalocyanine pigments. In consideration of environmental friendliness and subsequent processing after use, a photosensitive member using organic compound is preferable.

The static eliminating mainly includes a lamp capable of emitting light with a predetermined strength. From this lamp, light for eliminating static is emitted to the static eliminating position to release the charged state on the surface of the photosensitive member 1 passing through the static eliminating position. With this, the surface potential of the photosensitive member 1 after passing through the transfer position is returned to an initial state.

The charging unit 2 can use any one of a corona scheme, a roller scheme, a brush scheme, and a blade scheme. Here, the charging unit 2 of a roller scheme is used. The charging unit 2 includes a charging roller 2*a*, a charging-roller cleaning member 2*b* in a roller shape abutting on the charging roller 2*a* and cleaning the charging roller 2*a*, and a power supply not shown electrically connected to the charging roller 2*a*. Therefore, the charging unit 2 applies a high voltage to the charging roller 2*a* in a predetermined manner to cause corona discharge between the charging unit 2 and the photosensitive member 1. With this, the surface of the photosensitive member 1 is uniformly charged.

The developing unit 4 includes, for example, a developing-agent carrier 4*a* that carries a developing agent for supply to the photosensitive member 1, and a toner supply room having stored therein a developing agent for refilling the developing-agent carrier 4*a*.

The developing-agent carrier 4*a* includes a rotatably-supported developing sleeve member in a hollow cylindrical shape, and a magnet roll fixed to the same shaft inside the developing sleeve member. With the developing-agent carrier 4*a* being rotatingly driven, the developing agent is magnetically absorbed onto the surface of the developing sleeve member as a perimeter surface of the developing-agent carrier 4*a* for conveyance to the photosensitive member 1 side. That is, the developing sleeve member is formed of a conductive non-magnetic member, and has connected thereto a power supply not shown for applying a developing bias. A voltage from the power supply is applied between the developing sleeve member and the photosensitive member 1 to set the closest approaching position therebetween as a developing position. Also, an electric field is formed in a developing area at this developing position. Therefore, in the developing-agent carrier 4*a*, a toner brush is generated with toner particles radially protruding from the surface of the developing sleeve member. Then, toner particles at the tip of a new toner brush of the developing-agent carrier 4*a* rotatingly driven are always attached to a latent image generated at a predetermined position on the surface of the photosensitive member 1 and moved on the perimeter according to the rotation of the photosensitive member 1 to pass through the developing position, thereby causing the invisible latent image to be visible as a toner image of the relevant color.

Here, the toner supply room is configured to always store an amount of developing agent so that the developing agent can be magnetically absorbed onto a lower portion of the developing-agent carrier 4*a*. At the bottom of this toner supply room, two mixing members 4*b* and 4*c* axially supported in parallel to each other are disposed. Between these mixing members 4*b* and 4*c*, a partition-like plate is disposed so as to partition these mixing members 4*b* and 4*c* other than both ends in an axial longitudinal direction. Around each of these mixing members 4*b* and 4*c*, a spiral conveying surface is formed in a predetermined winding manner over an entire area in an axial longitudinal direction, and the rotating directions of the mixing members 4*b* and 4*c* are opposite to each other according to the spiral winding direction. Therefore, one of the two mixing members 4*b* and 4*c* conveys the developing agent in the axial longitudinal direction with reversed orientation, and delivers the conveyed developing agent to the other one of the mixing members 4*b* and 4*c* facing at its axial end. With this, the developing agent revolves in a predetermined closed route. In the course of revolving, the exiting developing agent in the room is sufficiently mixed with a new developing agent supplied through a supply route (not shown) for equalization as a developing agent. Also, with the mixing operation, frictional electrification is performed.

Here, one end of the supply route is connected to a toner accommodation container (not shown) provided at a predetermined position in the image forming apparatus body. The toner accommodation container is formed of a toner bottle having accommodated therein a predetermined amount of new toner. Based on detection results of a toner density sensor (not shown) provided to the toner supply room, when it is determined that the developing-agent toner density is decreased in the room, the toner supply room is refilled with a new toner from the toner accommodation container via the supply route.

Referring again to FIG. 1, the exposing unit 3 is disposed above the image forming units 10K, 10C, 10M, and 10Y. The latent-image forming position on each of the photosensitive members 1K, 1C, 1M, and 1Y in each of the image forming units 10K, 10C, 10M, and 10Y is irradiated with laser light, thereby causing the electrostatic latent image to be written. That is, the exposing unit 3 converts data read by the document reading part 400 and an image signal transmitted from an external device, such as a personal computer (PC) (not shown), causes a polygon mirror to scan with the laser light and, based on the image signal read through a mirror, causes an electrostatic latent image to be formed on the photosensitive member 1.

The transfer unit 5 includes the intermediate transfer belt 50 having temporally stored thereon a full-color toner image formed by sequentially superposing toner images of respective colors formed on the respective photosensitive members 1. The color toner image held on the intermediate transfer belt 50 through a primary transfer from each photosensitive member 1 is transferred to a sheet of paper through a secondary transfer.

That is, with supporting rollers as four main rollers disposed in a predetermined manner in an apparatus body and a secondary-transfer roller, the upper surface of the intermediate transfer belt 50 tightly stretched as described above extends in a horizontal direction and protrudes downward. Also, the belt moves endlessly at a predetermined velocity according to the rotating velocity of the photosensitive member 1.

A primary transfer unit 51 is disposed at a position facing the photosensitive member 1 across the intermediate transfer belt 50. The primary transfer unit 51 has connected thereto a power supply (not shown), and is supplied with a predetermined voltage from the power supply. Therefore, when the toner image on the photosensitive member 1 is transferred onto the intermediate transfer belt 50, a voltage is applied to the primary transfer unit 51 to form an electric field between the photosensitive member 1 and the intermediate transfer belt 50, thereby causing the toner image to be electrically transferred from the photosensitive member 1 to the intermediate transfer belt 50.

Here, the description above is not meant to be restrictive. Alternatively, a sheet may be conveyed by a transfer conveyer belt to cause a toner image on each photosensitive member 1 to be directly transferred to the sheet. Furthermore, as an intermediate transfer body that temporarily carries a toner image, an appropriate structure, such as a cylindrical drum body with a large diameter, can be used instead of a belt body, such as the intermediate transfer belt 50.

Also, a secondary transfer roller at a belt side supporting the intermediate transfer belt 50 from the inside of the intermediate transfer belt 50 so that the intermediate transfer belt 50 protrudes downward is provided with a secondary transfer roller at an apparatus body side oppositely disposed from the bottom via the intermediate transfer belt 50 and pressed so as to make contact with the secondary transfer roller at the belt side. With this, a nip portion is formed as a transfer position with a predetermined pressure secured between the secondary transfer roller and the intermediate transfer belt 50.

At a position immediately before the nip portion in a conveying path to the nip portion, paired resist rollers with a conveying timing for toner image transfer being secured are placed. Also, a conveyer belt for conveying a sheet from this nip to the fixing unit 7 is placed in the course of the conveying path.

The fixing unit 7 includes a belt stretched over a roller having a halogen heater or the like therein, and a pressure roller. With a nip formed between the belt and the pressure roller, heat and pressure are applied to the toner on the sheet to cause the toner image to be fixed onto the sheet. That is, the fixing unit 7 includes, as heating members serving as a temperature supplying member for fixing, a large-diameter roller and a smaller diameter roller spaced a predetermined distance apart from each other in an approximately horizontal direction so as to face each other, and a belt stretched over both of the rollers. The small-diameter roller has incorporated therein a heating source, such as a halogen heater. On the other hand, as a pressuring member serving as a pressure supplying member for fixing, the pressure roller is provided so as to face a lower portion of the large-diameter roller to make contact with a portion of the large-diameter roller around which the belt is wound, and is pressed in a predetermined manner toward the large-diameter roller side. Also, at least to a roller shaft of the large-diameter roller, a predetermined rotation driving force is transferred from the image forming apparatus body side, thereby causing the large-diameter roller to be rotatingly driven at a constant velocity in a predetermined direction.

Here, the fixing unit 7 is not meant to be restricted to the one mentioned above, and may have a configuration using a pair of rollers or a pair of belts.

Therefore, in the copier 100 configured as described above, the document reading part 400 reads an image from a document surface through the manual operation or automatic reading described above. Based on the image, the image forming part 300 forms a color-toner image as appropriate. The formed color-toner image is then transferred and fixed onto a sheet advancing on the conveying path from the paper feeding part 200 after selection of size and type as appropriate. The sheet with the color image fixed thereon is eventually delivered onto the paper delivery tray 8.

Furthermore, the copier 100 includes a both-sides reversing unit 9, in addition to the various parts and units described above. That is, the both-sides reversing unit 9 has formed therein a reverse conveying path formed in advance by using a plurality of paired rollers disposed in a predetermined manner and a guide member (not shown). An inlet of the reverse conveying path is connected to a position on the conveying path between the fixing unit 7 and the paper delivery tray 8. On the other hand, an outlet thereof is connected to a position before the image forming unit 10. Near the inlet, the guide member is disposed which is configured to allow selection of a sheet advancing direction as either one of the conveying path or the reverse conveying path to the paper delivery tray 8 for switching. Therefore, when the user selects a both-sides copy mode, the guide member is switched to allow a guide direction to be directed to the reverse conveying path. With this, the sheet with an image fixed thereon is introduced to the reverse conveying path of the both-sides reversing unit 9. The both-sides reversing unit 9 then causes the sheet to make reciprocating movement on the reverse conveying path to turn the sheet surface upside down, and then returns the sheet to the conveying path from the position before the image forming unit 10. The sheet is then conveyed on the conveying path and is again guided to the transfer position. This time, after an image is transferred and fixed onto the back of the sheet, the sheet is eventually delivered onto the paper delivery tray 8.

Figure 4:
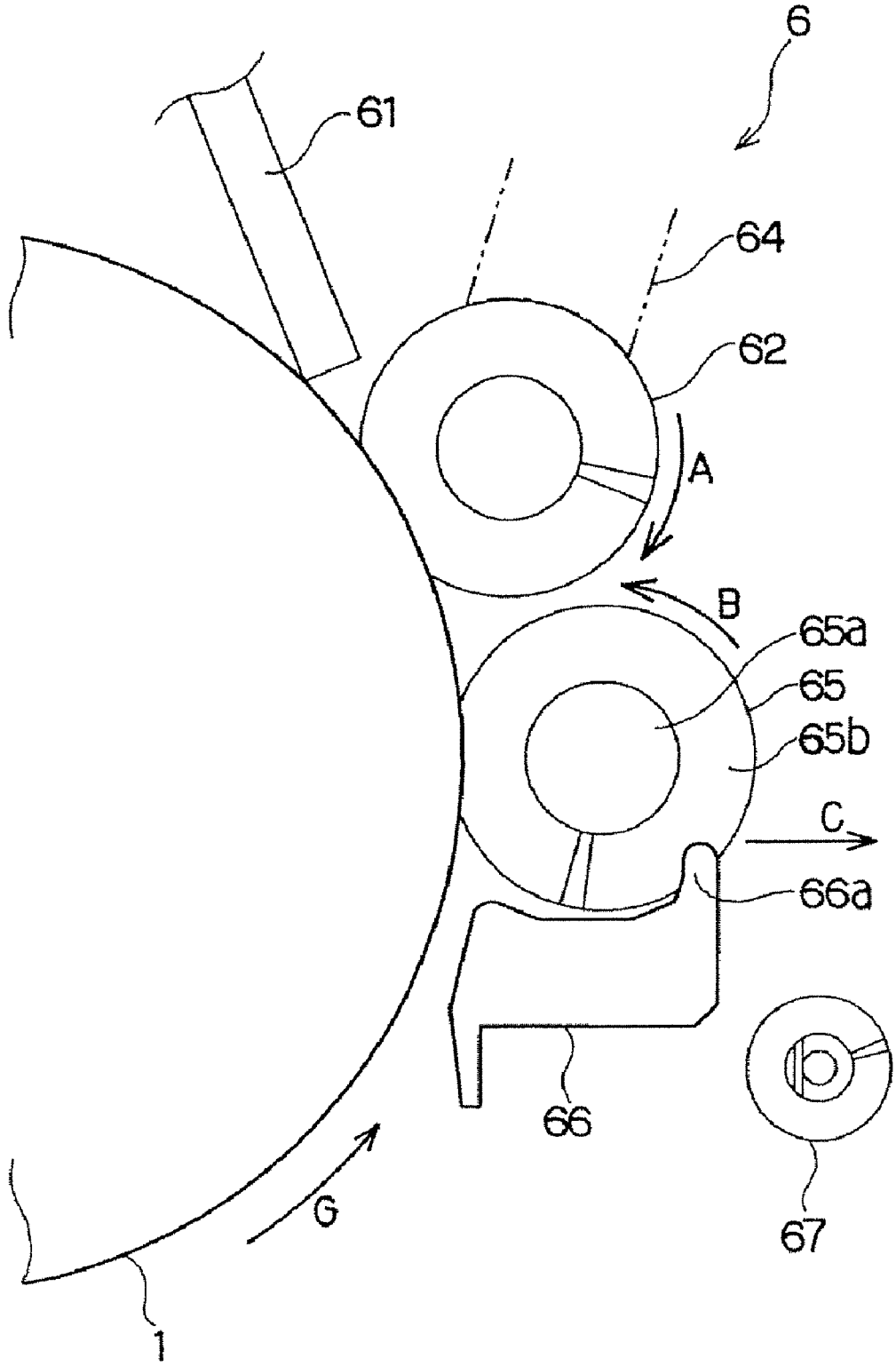
FIG. 4 is a schematic view of the cleaning device, mainly depicting a cleaning blade, a lubricant-applying brush roller, and a cleaning brush roller shown in FIG. 2.
Figure 5:
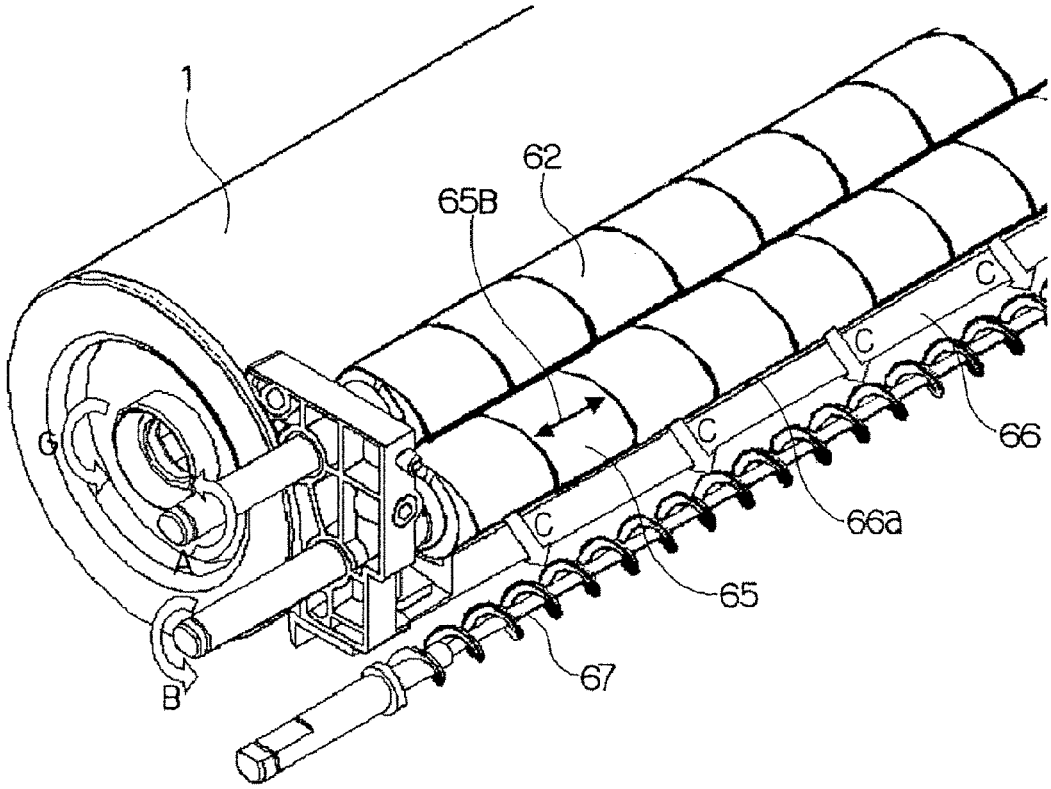
FIG. 5 is a schematic perspective view of the cleaning device, mainly depicting the lubricant-applying brush roller, the cleaning brush roller, and a flicker shown in FIG. 2 for explaining the operation of the cleaning brush roller.

Next, by using FIGS. 2 and 4 to 6, the configuration of the cleaning device 6 according to the first embodiment is described. The cleaning device 6 includes, as shown in FIGS. 2 and 4, a cleaning blade 61 abutting on the photosensitive member 1, a lubricant-applying brush roller 62 that scratches a solid lubricant 64 for supply onto the photosensitive member 1, and a cleaning brush roller 65. That is, near the photosensitive member 1, from an upstream side to a downstream side in a rotating direction of the photosensitive member 1 as a counterclockwise direction in the drawings and from a downstream side to an upstream side at a position near the side of the photosensitive member 1, the following components are sequentially disposed: the cleaning brush roller 65 rotatingly driven in a predetermined manner so that the tip of brush bristles abuts on the surface of the photosensitive member 1; the lubricant-applying brush roller 62 rotatingly driven in a predetermined manner for applying the solid lubricant 64 onto the surface of the photosensitive member 1; and the cleaning blade 61 having a blade edge uniformly abutting on the surface of the photosensitive member 1 and over an entire area in an axial longitudinal direction of the photosensitive member 1.

In more details, the lubricant-applying brush roller 62 has brush bristles, and has a roller-rotation center line parallel to a rotation center line of the photosensitive member 1. Also, the lubricant-applying brush roller 62 is spaced apart from the photosensitive member 1 so that the tip of the brush bristles abuts on the surface of the photosensitive member 1 in a predetermined manner. Furthermore, the lubricant-applying brush roller 62 has a roller shaft rotatably supported by a bearing or the like (not shown). Approximately above the lubricant-applying brush roller 62, the solid lubricant 64 is disposed as always being pressed so that its lower end makes contact with the lubricant-applying brush roller 62. That is, the solid lubricant 64 is accommodated in a case member having an opening on the lubricant-applying brush roller 62 side, and is held so as to be slidably moved in a direction closer to the lubricant applying brush roller 62. Also, an elastic member, such as a coil spring, in contact with an upper end of the solid lubricant 64 is disposed as being compressed. With resilience of this elastic member, the solid lubricant 64 is always pressed in the direction closer to the lubricant applying brush roller 62.

As the solid lubricant 64, one having zinc stearate as a main ingredient or one at least including zinc stearate and homogeneously solidified in a predetermined manner as appropriate is used. Therefore, since the solid lubricant 64 is formed mainly of zinc stearate, the lubricant can be correctly and accurately formed in a predetermined shape as a solidified lubricant. On the other hand, the solid lubricant 64 has an excellent application ability, thereby preventing unevenness when applied. Thus, it is possible to prevent unstable transfer efficiency of the photosensitive member 1 due to unevenness in the amount of application, that is, variations in the amount of application.

Here, the solid lubricant 64 for use can be the following materials, which merely serve as examples and are not restrictive. That is, these materials are solids with a lubricating property, including: various fluorine-containing resin, such as polytetrafluoroethylene (PTFE) and polyvinylidene difluoride (PVDF); silicone resin; polyolefin resin; silicon grease; fluorine grease; paraffin wax; fatty acid metallic salt, such as zinc stearate; graphite; and molybdenum disulfide.

Therefore, the lubricant-applying brush roller 62 has, as being rotatingly driven, the tip of brush bristles slidably attached to the lower end of the solid lubricant 64 to shave it to powder. Then, the tip of the brush bristles with the shaved powder-like solid lubricant 64 attached thereto further makes contact with the surface of the photosensitive member 1 at a downstream side in the roller rotating direction. The powder-like solid lubricant 64 is then transferred and applied from the tip of the brush bristles onto the surface of the photosensitive member 1. In this manner, the solid lubricant 64 is continued to be supplied onto the photosensitive member 1 until the solid lubricant 64 is shaved to have a predetermined small size.

The cleaning device 6 mainly including the cleaning blade 61 that eventually scrapes residues off the surface of the photosensitive member 1 for removal includes the cleaning blade 61 abutting on the surface of the photosensitive member 1 with a predetermined abutting angle and a predetermined abutting pressure ensured by the blade edge, a supporting member that slidably supports the cleaning blade 4, and an elastic member, such as a pressure sprint or plate spring, that presses the supporting member in a predetermined sliding direction to ensure the predetermined abutting pressure for the cleaning blade 4.

That is, the cleaning blade 61 is formed in an elongated plate made of synthetic rubber so as to allow elastic deformation, and is ensured to have a plate length at least longer than an area where a latent image is formed on the photosensitive member 1. Also, by being supported by the pressured supporting member, the cleaning blade 61 has formed at its tip side a blade edge (blade ridgeline) that ensures the predetermined abutting angle and the predetermined abutting pressure to abut on the perimeter surface of the photosensitive member 1, thereby forming, as a linear abutting portion between the cleaning blade 4 and the photosensitive member 1, a continued straight line parallel to the longitudinal direction of the photosensitive member 1.

In the cleaning device 6 configured as described above, the rotating direction of each roller 62 and 65 is the one allowing the solid lubricant 64 to be efficiently applied onto the surface of the photosensitive member 1 by the lubricant-applying brush roller 62. This rotating direction allows residual transfer toner on the surface of the photosensitive member 1 and filming to be efficiently removed by the cleaning brush roller 65.

That is, the rotating direction of the lubricant-applying brush roller 62 is a forward direction B following a rotating direction G of the photosensitive member 1, as shown in FIGS. 2 and 4. Therefore, near the tip of the brush bristles of the lubricant-applying brush roller 62 in contact with the surface of the photosensitive member 1, a portion at the tip side of the brush bristles is bent for a predetermined amount according to an amount of engagement set in the lubricant-applying brush roller 62 so as to pass the surface. Therefore, the side surface near the tip of the brush bristles can sufficiently come into contact, and also a sufficient contact time can be ensured. With this, the powder-like solid lubricant 64 attached near the tip of the brush bristles can be efficiently transferred to the surface.

On the other hand, the rotating direction of the cleaning brush roller 65 is a reverse direction A opposite to the rotating direction G of the photosensitive member 1, as shown in the drawings. Therefore, a relative velocity difference between the photosensitive member 1 and the cleaning brush roller 65 at the portion where the brush bristle side of the cleaning brush roller 65 makes contact with the surface of the photosensitive member 1 is represented by a velocity value obtained by adding a circumferential velocity of the surface and a circumferential velocity of the tip of the brush bristles together as they are. Therefore, even if the cleaning brush roller 65 is rotatingly driven at a relatively low rotating velocity, a high relative velocity difference can be efficiently obtained. With the high relative velocity difference obtained in the manner described above, the tip of the brush bristles abuts on the surface of the photosensitive member 1 to be sufficiently bent, and the side surface near the tip makes contact with the surface of the photosensitive member 1 with the relative velocity difference being kept. Therefore, foreign substances on the surface can be stably attached to the brush bristle side. As a result, foreign substances can be efficiently removed.

Therefore, according to the cleaning device 6 configured as described above, foreign substances, such as toner left on the photosensitive member 1 after primary transfer, are removed and collected by the cleaning brush roller 65 from the photosensitive member 1. Then, fine particles of the solid lubricant 64 are supplied by the lubricant-applying brush roller 62 onto the photosensitive member 1. Thus, with the vibration factor of the cleaning blade 61 being eliminated as much as possible, the toner left on the photosensitive member 1, filming, and others are eventually scraped by the cleaning blade 61 and removed from the photosensitive member 1.

In the cleaning device 6 that performs the procedure described above, as a toner removing unit for the first cleaning, various units, such as a rubber blade or fur brush, can be used. As shown in FIGS. 2 and 4, the cleaning brush roller 65 and a flicker 66 that removes toner from the surface of the cleaning brush roller 65 is used as a unit that efficiently removes toner without damaging the surface of the photosensitive member 1.

That is, the cleaning brush roller 65 has many brush bristles implanted in a predetermined manner. The tip of these brush bristles are aligned so as to be positioned on a cylindrical surface as a roller perimeter surface without an external force being exerted on the brush bristles themselves. Also, the cleaning brush roller 65 is spaced a predetermined interaxial distance apart from the photosensitive member 1 so that the tip of the brush bristles abuts on the surface of the photosensitive member 1 in a predetermined manner. Furthermore, the cleaning brush roller 65 has a roller shaft supported parallel to the axis of the photosensitive member 1. A predetermined rotation driving force is transferred from the image forming apparatus side to the roller shaft, thereby allowing rotation driving in a predetermined rotating direction.

The flicker 66 has an engaging portion 66*a* that engages a bundle of bristles of the cleaning brush roller 65. That is, the flicker 66 is fixedly disposed under the cleaning brush roller 65 in parallel to the cleaning brush roller 65 so as to be spaced a predetermined distance apart therefrom, and the rib-like engaging portion 66*a* protruding upward is provided on an upper portion of the flicker 66. The tip of the engaging portion 66*a* engages the facing cleaning brush roller 65 by a predetermined amount for contact.

That is, the flicker 66 is formed in an approximately rectangular parallelepiped shape so as to be ensured to have a length longer than the cleaning brush roller 65, and has an upper surface facing the cleaning brush roller 65 formed in an approximately concave shape according to the perimeter surface of the cleaning brush roller 65. The flicker 66 is fixedly arranged in a frame member mounted in association with the process cartridge frame 71*a*. The flicker 66 has the engaging portion 66*a* protruding upward for a predetermined length, the engaging portion 66*a* being integrally formed on an outer edge of an opposite upper surface not facing the photosensitive member 1. The engaging portion 66*a* has an upper end aligned on a straight line in an approximately horizontal direction parallel to the axial direction of the cleaning brush roller 65. The engaging portion 66*a* also has a thickness set so as to allow the brush bristles of the cleaning brush roller 65 to be bent and to ensure stiffness that prevents the engaging portion 66*a* itself from being deformed even if the brush bristles of the cleaning brush roller 65 rotatingly driven come into contact with a strong impact. Here, the outer edge of the upper end of the engaging portion 66*a* is formed in a segment of a circle having a predetermined radius in section. With this, even if the brush bristles in bundles moving in association with the rotation of the cleaning brush roller 65 come into contact, the contacted brush bristles are prevented from being stuck.

Therefore, the cleaning brush roller 65 configured as described above has its brush bristles making contact with the surface of the photosensitive member 1, thereby causing foreign substances, such as toner, to be attached to the brush bristles from the photosensitive member 1. With this, the foreign substances can be removed from the photosensitive member 1. Also, as shown in FIG. 4 and particularly in FIG. 5, thus removed foreign substances, such as toner, on the cleaning brush roller 65 are scraped by the flicker 66 (flicking).

That is, the cleaning brush roller 65 is rotated in the B direction to cause bundles of bristles to collide with the flicker engaging portion 66*a*, the toner in the bundles of bristles (the toner scraped by the cleaning brush roller 65 from the photosensitive member 1) is flung off to a direction C (flicking). Thus flung toner is collected by a toner collection coil 67 provided under the cleaning brush roller 65 for delivery. Only the toner collected with foreign substances other than the toner being removed is returned to the toner supply room for reuse in developing, or is delivered to the outside of the cleaning device 6 or the image forming unit 10 and then is stored in the toner collection container as a discarding unit for disposal.

Here, the amount of engagement is appropriately set in consideration of the entire length of the brush bristles from a base end to the tip of the brush bristles, density of the brush bristles, and stiffness of the brush bristles themselves. According to the protrusion length as the amount of engagement and a protruding position, from the tip to the base end of the brush bristles, the flicker engaging portion 66*a* collides with and abuts on a portion on the brush bristles away by the length and the protruding position, that is, a portion on the brush bristles moving in association with the rotation of the cleaning brush roller 15.

Also, the cleaning device 6 according to the first embodiment is configured to prevent a flicking operation of the flicker 66 from simultaneously affecting over the entire area in the axial direction of the cleaning brush roller 65.

Figure 6:
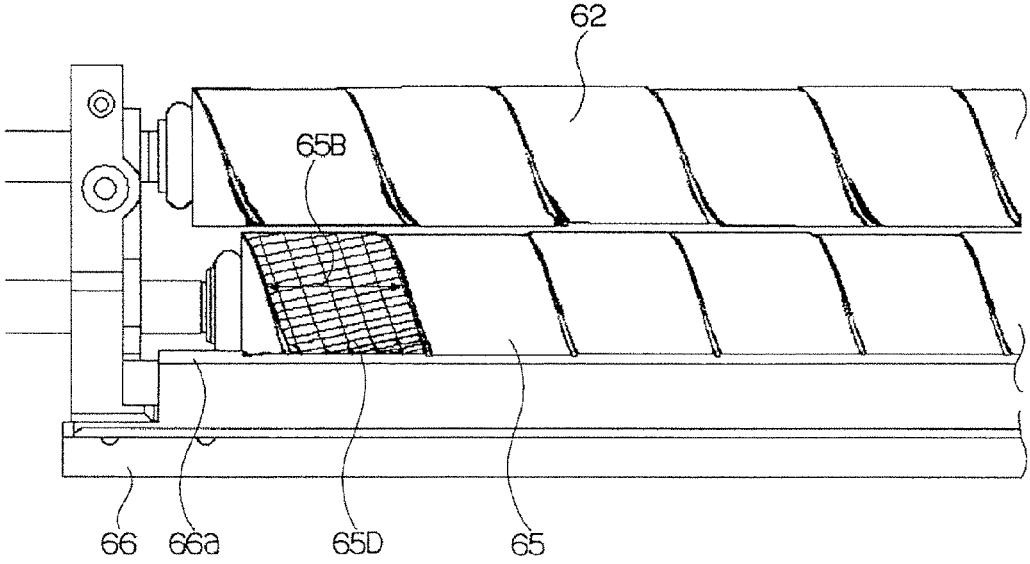
FIG. 6 is a schematic side view of the cleaning device, the cleaning brush roller, and the flicker.

That is, the bundles of bristles, which are brush bristles 65*b* of the cleaning brush roller 65 shown in FIG. 4 has a loop-brush structure instead of a straight-bristle brush. Each brush bristle 65*b* is formed by implanting a bent loop-shaped fiber in a predetermined manner. As shown in FIG. 6, a bristle alignment direction 65D of the cleaning brush roller 65 is not parallel to the axial direction of the cleaning brush roller 65 but has an angle. Thus, at the time of flicking, the bristles are prevented from repeating simultaneous contact with the flicker 66 and simultaneous separate from the flicker 66. In other words, with reference to the rotation center line of the cleaning brush roller 65, the bristle alignment direction 65D of the brush bristle 65*b* is set to be in a direction tilted at a predetermined angle.

Specifically, the cleaning brush roller 65 is configured by winding a base fabric around a metal core 65*a* in a spiral manner, the base fabric having a width 65B with loop-shaped bundles of bristles being implanted therein. In other words, the belt-shaped base fabric is wound around the perimeter surface of the cylindrical metal core 65*a* in a spiral manner, with the brush bristles 65*b* standing upright on the surface of the base fabric and with the bristle alignment direction 65D of the brush bristles 65*b* being set along in a width direction of the base fabric. Thus, the protruding direction of the respective brush bristles 65*b* from the approximately perimeter surface of the metal core 65*a* is set to be a radial direction and a radiating direction evenly for the entire perimeter centering on the center axis line of the metal core 65*a* as a shaft of the cleaning brush roller 65. Also, according to the tile of the spiral, the bristle alignment direction 65D is tilted with a predetermined tilt angle (helix angle) being ensured in the axial longitudinal direction of the cleaning brush roller 65. Therefore, on the perimeter surface of the cleaning brush roller 65, not all of the contactable brush bristles 65*b* arranged in an area from one end to the other end in the axial direction of the cleaning brush roller 65 simultaneously come into contact, but these brush bristles 65*b* are decimated, so to speak, in a predetermined manner for contact. For this purpose, the area is divided into a plurality of sections in the same axis direction and the brush bristles 65*b* are grouped into a predetermined number of rows for each section. Then, it is configured that the contact time and the contact-releasing time of brush bristles 65*b* belonging to the same group do not overlap those of brush bristles 65*b* belonging to another group.

That is, for example, the base fabric is configured by weaving a plurality of loop-shaped fabrics into a substrate fabric with warp and fill yarns to fill the substrate fabric with bundles of loop-shaped bristles. The substrate fabric is then cut in a fibrous direction with warp and fill yarns to obtain a belt shape having a predetermined length with the predetermined base-fabric width 65B being ensured. Also, the base fabric may be configured by weaving the bundles of loop-shaped bristles into a substrate fabric formed in a long belt shape having a predetermined length with warps and fill yarns arranged in advance in a length direction and a width direction, respectively.

Therefore, since the cleaning brush roller 65 is configured to be a loop brush roller, a higher cleaning ability can be obtained compared with a straight-bristle brush. That is, one brush bristle 65*b* is formed of a bundle of brush bristles formed of a plurality of fabrics as described above, the area making contact with the photosensitive member 1 is increased, as a matter of course, compared with a straight-bristle brush, thereby increasing cleaning ability. Furthermore, the bundles of loop-shaped brush bristles has a stiffness higher than that of a straight-bristle brush, a sliding and scrubbing force with respect to the photosensitive member 1 is increased. As a result, a high cleaning ability can be achieved. Still further, it can be expected to smoothly and reliably remove a thin toner filming layer on the surface of the photosensitive member 1.

On the other hand, the loop brush roller can cause less damage on the photosensitive member 1, compared with a straight-bristle cut-pile brush. That is, in the cut-pile brush, since an acute cut surface at the tip of the brush bristles makes contact with the surface of the photosensitive member 1, flaws by scrubbing or scratches may be produced on the surface. On the other hand, in the cleaning brush roller 65 with bundles of loop-shaped bristles being implanted thereon, no cut surface is present on the tip of the brush bristles. So-called a round or back portion of the brush bristle fibers always slidably scrub the surface. Therefore, at least a deep scratch can be prevented, and merely shallow flaws by scrubbing will be caused if any.

Still further, the bristle alignment direction 65D of the cleaning brush roller 65 is tiled at a predetermined angle, instead of being parallel to the axial direction of the cleaning brush roller 65. With this, at the time of rotation, the bristles plated somewhere in the longitudinal direction always make contact with the engaging portion 66*a* of the flicker 66. Therefore, flicking is performed smoothly in a manner similar to the case of helical-gear transmission. That is, in a manner similar to the case of a contact between two helical gears, any of the brush bristles 65*b* always make contact, instead of making contact in a clearly intermittently cycle. In this sense, as a whole, the brush bristles 65*b* are kept approximately continuously making contact. Thus, a continuous, smooth flicking operation with few variations can be achieved. Accordingly, vibrations occurring due to the flicking operation are decreased.

That is, in the conventional configuration in which the bristle alignment direction of the brush bristles is set to be parallel to the cleaning brush roller axis, a predetermined number of brush bristles are implanted so as to be equally spaced apart on the outer edge of the perimeter in a section of the cleaning brush roller. In any section of the cleaning brush roller in the axial longitudinal direction, the number of brush bristles is the same, and also the protruding position of each brush bristle on the circumference is the same. That is, the angular position where the brush bristles protrude in a radial direction is the same at any position in the axial longitudinal direction. Therefore, at the time of rotation of the cleaning brush roller, if some brush bristles occupy a rotational angular position in contact with the photosensitive member, all brush bristles occupying the same rotational angular position in the axial longitudinal brush roller surely make contact with the photosensitive member similarly.

Figure 7:
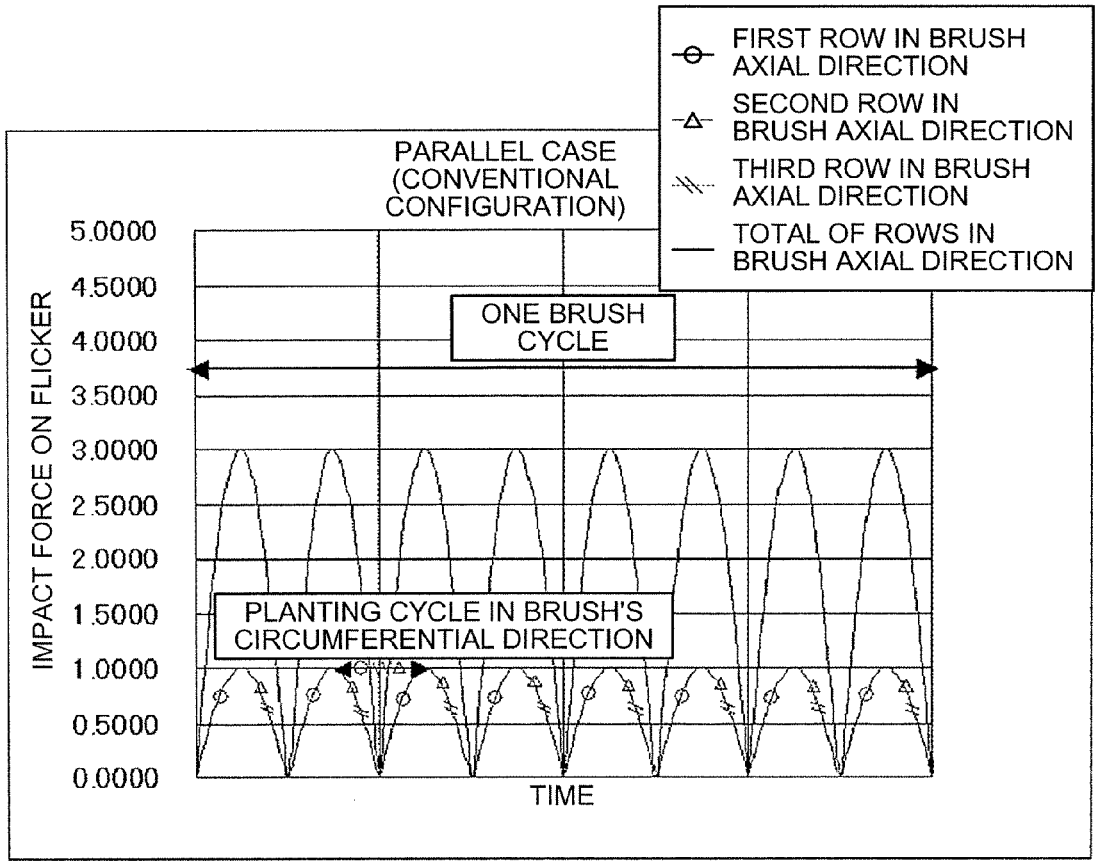
FIG. 7 is a graph of change in impact force per rotational cycle of the cleaning brush roller on the flicker when brush bristles are aligned in parallel to the axis of the cleaning brush roller.

As such, in the conventional configuration in which the bristle alignment direction of the brush bristles is set to be parallel to the brush roller axis, as shown in a graph of FIG. 7, bristles on a first row to those on a third row in a brush axial direction simultaneously collide with and go away from the flicker. Therefore, an impact force on the entire flicker and its amplitude are both increased. That is, so to speak, the bristles on the first row to those on the third row synchronously collide with the flicker engaging portion together, and go away therefrom together. Therefore, colliding bristles are all of the brush bristles along the longitudinal axial direction of the brush roller, that is, always approximately the maximum number of bristles. Thus, the contact timing of brush bristles in each row becomes the same synchronized time, thereby causing impact forces caused by collision of the brush bristles to be converged into a total sum. As a result, a peak (maximum value) of an impact force per each collision due to contact of the brush bristles and amplitude (a difference between a minimum value and the maximum value) are increased. In other words, the number of times the brush bristles making contact as a brush roller in one roller rotation cycle is equal to the number of bristles on the circumference.

Figure 8:
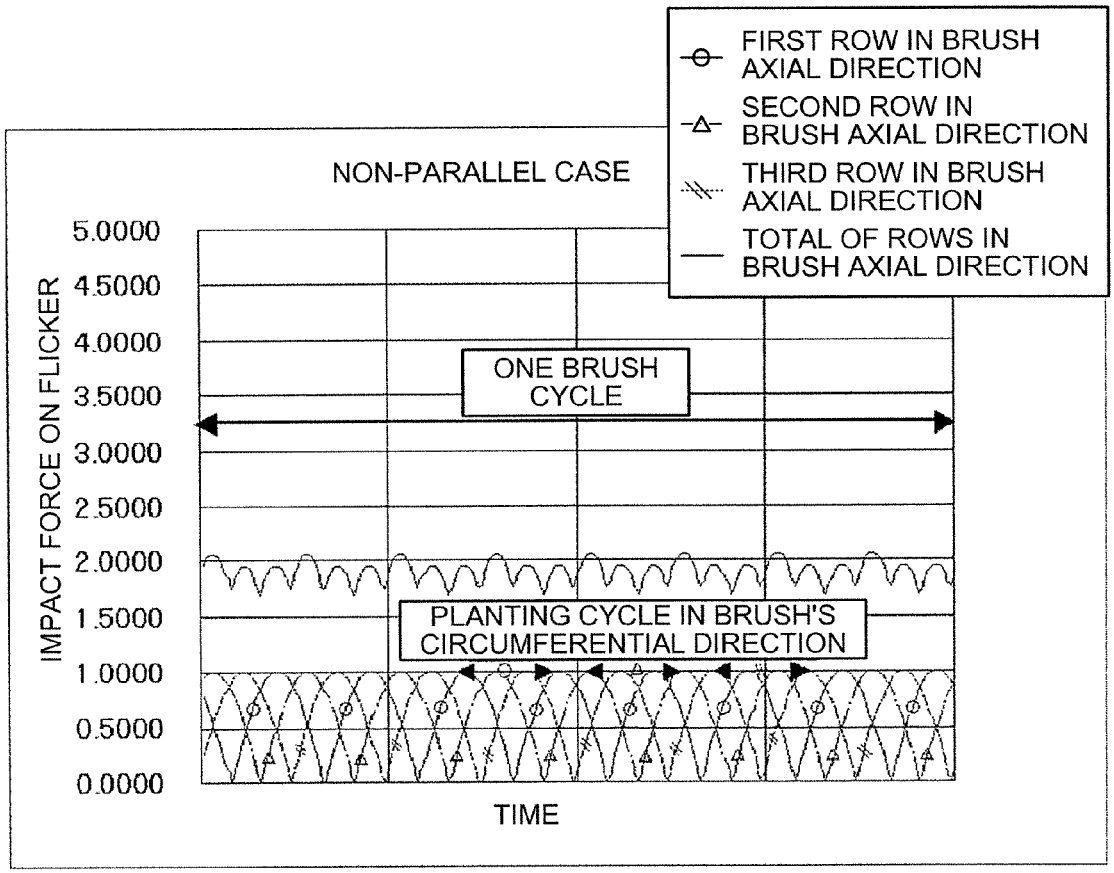
FIG. 8 is a graph of change in impact force per rotational cycle of the cleaning brush roller on the flicker when brush bristles are aligned in non-parallel to the axis of the cleaning brush roller.

By contrast, in the case of a non-parallel alignment, as shown in FIG. 8, bristles on a first row to those on a third row in a brush axial direction do not simultaneously collide with the flicker, but collide therewith a predetermined time difference. Therefore, the impact force on the entire flicker is decreased.

That is, the number of bristles at the time of collision is not the total number of the bristles, but remains one third of the total number, for example. Accordingly, an interval among collisions of three rows is shortened. In other words, the number of times the brush bristles making contact as a cleaning brush roller in one roller rotation cycle is significantly larger than the number of bristles on the circumference, and is twice as many as this number. Therefore, the impact occurring per contact is dispersedly positioned on a time axis, and accordingly is smaller than the total impact force described above. Thus, a small impact force obtained by dividing the total impact force occurs many times.

Here, the rows shown in the graphs of FIGS. 7 and 8 are referred to as the first row, the second row, and then the third row in the brush axial direction in each base fabric width 65B area obtained by partitioning the brush bristles implanted on the perimeter surface of the cleaning brush roller by the length of the base fabric width 65B in a brush axis (in a brush-roller axial longitudinal direction). A graph line for the first row indicative of a state of variations in impact force in one roller rotation cycle is represented by a solid line with circle marks. A graph line for the second line is represented by a one-dot-chain line with small triangle marks. A graph line for the third line is represented by a broken line with parallel backslashes.

Also, in the graph of FIG. 7 depicting the conventional configuration, the graph lines indicative of behaviors of the impact forces of these first to third rows are superposed one another because their occurring and disappearing timings are synchronized with one another and the magnitude of force is approximately the same. Therefore, these graph lines are represented as one graph line.

In this manner, for convenience in description, three rows from the first to third are described as a representative example. Even for n actual rows more than three, the bristles on the n rows collide in a dispersed manner at different colliding times, similarly to the case descried above. Therefore, similar operation effects can be obtained from the configuration of the present embodiment.

Consequently, according to the configuration of the first embodiment, it is possible to prevent the occurrence of a specific peak in a vibration frequency in the photosensitive member, such a peak being a factor of producing an image with a degraded image quality, such as a banding image.

Figure 9:
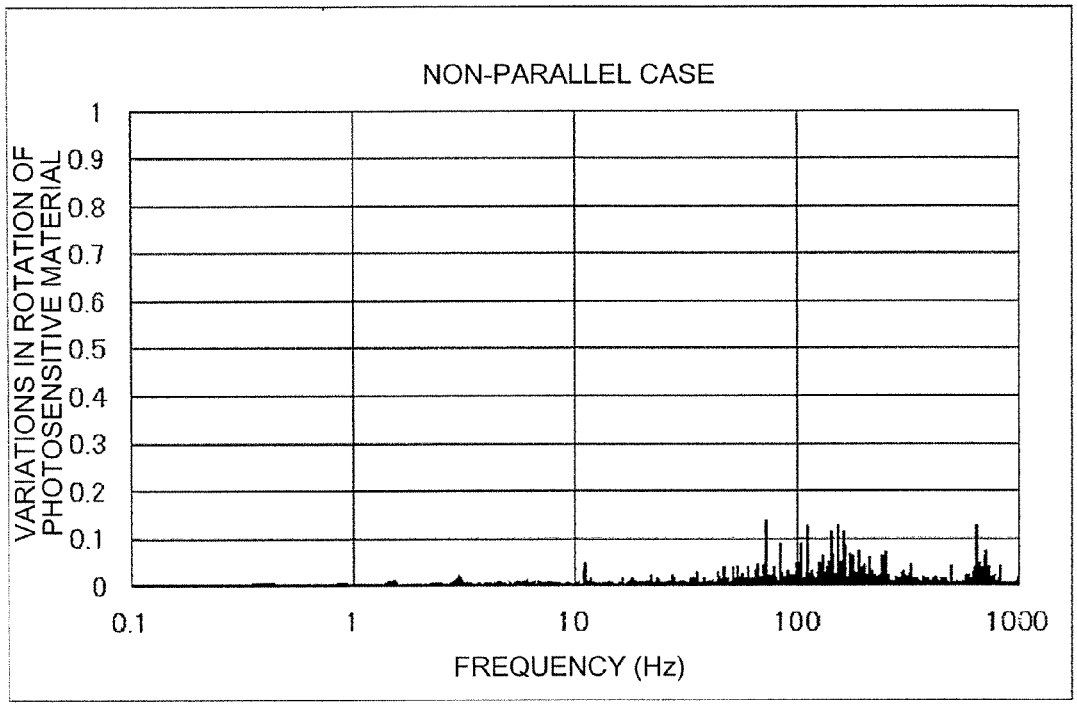
FIG. 9 is a graph of results of frequency analysis of rotational variations measured on a photosensitive member shown in FIG. 1 cleaned by the cleaning device.
Figure 11:
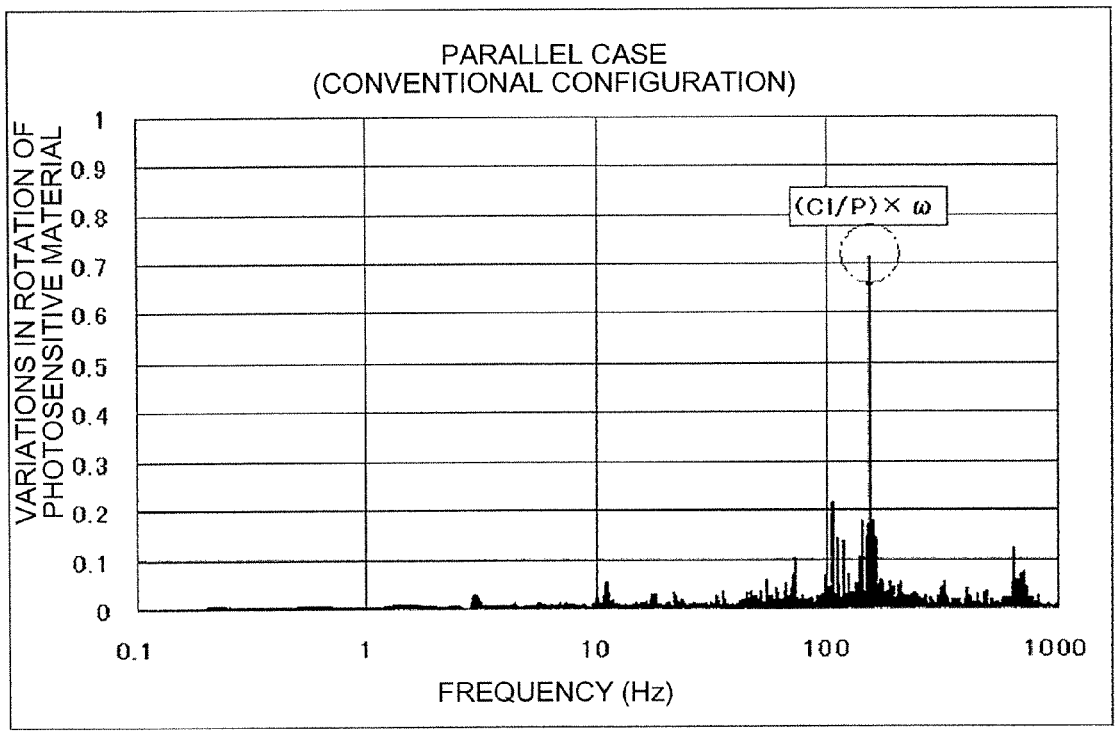
FIG. 11 is a graph of results of frequency analysis of rotational variations measured on a photosensitive member cleaned by the cleaning device shown in FIG. 10.

That is, for comparison between the effect according to the conventional configuration and the effect according to the configuration of the present embodiment, results of frequency analysis on fluctuations in rotation of the photosensitive member are depicted in FIGS. 9 and 11. A case is depicted in FIG. 11 according to the conventional configuration in which the bristle alignment direction 65D of the brush bristles is parallel to the cleaning brush roller axis, whist another case is depicted in FIG. 9 according to the configuration of the present embodiment in which this direction is not parallel thereto.

In the conventional parallel case, as clearly depicted in the graph of FIG. 11 taken as a comparison example, a peak resides at $(CI/P)\times\omega$ Hertz. However, in the case where the bristle alignment direction 65D is not parallel to the cleaning brush roller axis, that is, in the case according to the present embodiment where the bristle alignment direction 65D of the brush bristles is not parallel to the cleaning brush roller axis with a predetermined tilt angle, as depicted in the graph of FIG. 9, it can be said that no particular peak is present. That is, in the conventional configuration, degradation in image quality, such as banding, may possibly occur due to the peak frequency unique to that configuration. By contrast, in the configuration according to the present embodiment, no peak frequency is present, thereby preventing degradation in image quality. Here, in the equation representing the peak of the impact force in the conventional configuration, the circumference of the cleaning brush roller is CI millimeters, a filling pitch in a circumferential direction of the cleaning brush roller (a space between brush bristles in a circumferential direction) is P millimeters, and the number of rotation of the cleaning brush roller (the number of rotation per second) is $\omega$ rev/s.

Here, a total value of impact forces per one rotation cycle of the cleaning brush roller 65 is the same for both of the parallel case and the non-parallel case. Degradation in cleaning ability due to attachment of toner in the bundles of brush bristles due to a degradation in flicking ability does not occur. That is, the total impact force per one rotation cycle of the cleaning brush roller 65 obtained from the configuration according to the present embodiment is strictly the same as that according to the conventional configuration. However, the peak value of the impact force in the rotation cycle is reduced, and the amplitude (the difference between the minimum value and the maximum value) is decreased to a degree that it is regarded that an approximately constant impact force is always produced. In other words, the total number of brush bristles in contact with the surface of the photosensitive member 1 per one rotation of the cleaning brush roller 65 is identical to that according to the conventional configuration, but the contact timings of the respective brush bristles are not the same but are dispersed on the time axis, and the number of times of contact is significantly increased.

Also, the tilt angle (helix angle) in the bristle alignment direction with reference to the brush-roller axial longitudinal direction, that is, the brush-roller rotation center line, is set as appropriate so as to minimize the magnitude of vibration defined by the peak value and amplitude of the impact force, in consideration of the stiffness of the brush bristles and their length, and the amount of engagement by the engaging unit into the bundles of brush bristles. This is determined, for example, through a comparison test in which a plurality of actual devices with different tilt angles being set are used to measure the frequency.

Furthermore, as described above, the cleaning brush roller 65 is formed by winding the base fabric with the brush bristles 65*b* aligned in a belt width and in a length direction around the cylindrical metal core 65*a* in a spiral manner without overlapping. More strictly, the bristle alignment direction 65D is on a slightly-curved segment of an oval obtained by sectioning the cylinder. For example, an angle formed by a tangent of an approximately center portion in the curved-segment line with respect to the roller axial longitudinal direction (roller rotation center line) is the tilt angle.

As described above, according to the cleaning device 6 of the first embodiment, a flicking operation for scraping (flicking) the toner attached to the cleaning brush roller 65 is prevented from simultaneously occurring over the entire area in the axial direction of the cleaning brush roller 65. So to speak, a flicking operation occurring due to each brush bristle 65*b* over the entire area is dispersedly provided at a different time on the time axis. Therefore, while the flicking ability is kept, vibrations occurring at the time of flicking can be mitigated. That is, it is possible to prevent flicking operations by the brush bristles 65*b* from being locally concentrated on the time axis to become a large reaction force (vibrations). Therefore, vibrations that will affect image quality, for example, those producing a banding image, can be prevented from being propagated. That is, variations in density in a sub-scanning direction called banding can be prevented from appearing on an image, resulting in improvement in image quality.

Furthermore, in the cleaning device 6 according to the first embodiment, the belt-shaped base fabric with brush bristles 65*b* aligned and implanted in the belt-length direction and the belt-width direction is wound around the cylindrical brush body (metal core 65*a*) in a spiral manner to form a cleaning brush roller 65. Also, the tilt angle defined by a length by which the spiral proceeds per unit length in the roller axial longitudinal direction is set. Thus, the brush bristles 65*b* of the cleaning brush roller 65 are divided by the unit of approximately a belt width in the roller axial longitudinal direction, and the brush bristles 65*b* are aligned on lines at a predetermined tilt angle in each divided area. Therefore, in each area obtained by dividing by the unit of approximately a belt width, the brush bristles 65*b* evenly make contact with and go away from the photosensitive member 1, and there is no unbalance over the entire area in the longitudinal direction of the cleaning brush roller 65. That is, at least one of the brush bristles 65*b* starts to make contact with the photosensitive member 1 in each area, and another one of the brush bristles 65*b* goes away therefrom in each area. Therefore, even if vibrations occur due to such contacting and going away of the brush bristles 65*b*, the vibrations can be evenly dispersed over the entire area, instead of being unbalanced to a particular area in the longitudinal direction of the cleaning brush roller 65. As a result, partial vibrations in the axial longitudinal direction of the photosensitive member 1, which would otherwise cause degradation in image quality in a portion of an image, can be suppressed from being propagated. This can also achieve improvement in image quality.

In particular, in the cleaning device 6 according to the first embodiment, a loop brush roller with bundles of loop-shaped bristles implanted thereon is used. Therefore, the stiffness is increased compared with a straight-bristle brush. With such advantages of high cleaning ability from the loop-shaped bundles of bristles with a high stiffness, vibrations that would be increased due to the high stiffness can be sufficiently suppressed. In other words, it is possible to make full use of the cleaning ability of the loop brush roller without being restricted by the vibration factor.

Next, a second embodiment according to the present invention is described. Here, components identical to those in the first embodiment are provided with the same reference numerals, and are not described or simply described herein. That is, although not particularly mentioned, configurations not described in the second embodiment, such as the configurations of the cleaning device and others, and the respective operations are identical to those in the first embodiment.

In the first embodiment described above, compared with the conventional configuration, the configuration of the cleaning brush roller 65 itself is modified. In the second embodiment, the configuration of the flicker 66 is modified to obtain similar operation effects.

Figure 10:
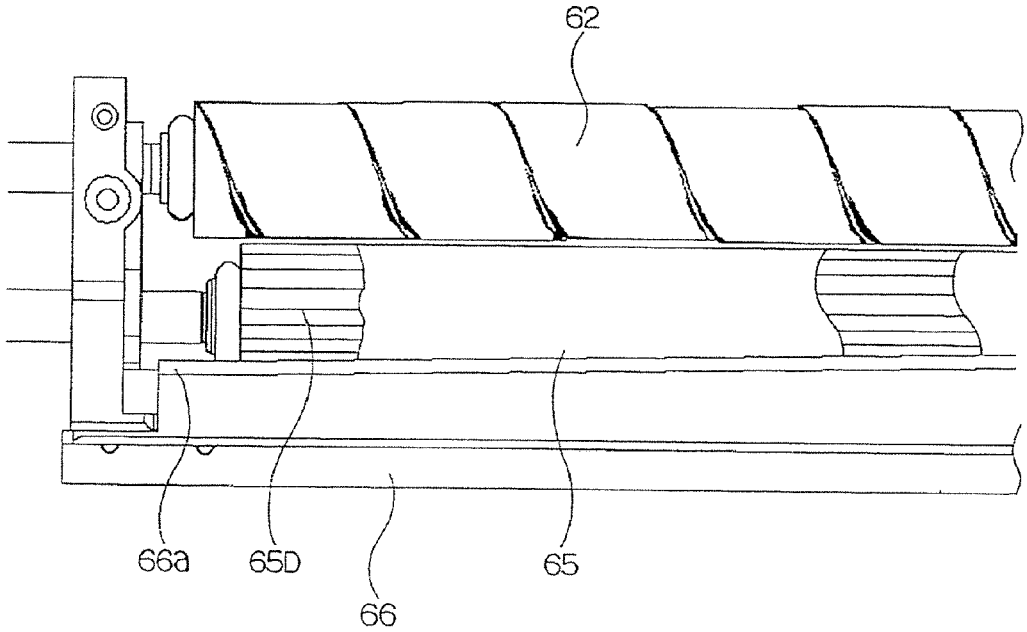
FIG. 10 is a schematic side view of a cleaning device according to a second embodiment of the present invention.

As described above, the flicker 66 has the engaging portion 66*a* integrally formed therewith, the engaging portion 66*a* not only making contact with the tip of the brush bristles 65*b* of the cleaning brush roller 65 but also engaging in the bundles of brush bristles 65*b*. Furthermore, in the second embodiment, as shown in FIG. 10, the longitudinal direction of the outer edge of the upper end of the engaging portion 66*a* is not parallel to the axial longitudinal direction of the cleaning brush roller 65, but is tilted so as to have a predetermined tilt angle. That is, the outer edge of the upper end of the engaging portion 66*a* is formed not in an intermittent manner in the longitudinal direction but in a predetermined continuous form. At each position on the roller axial longitudinal direction, the upper-end outer-edge portion is formed so as to be along with a predetermined-shaped line with a predetermined tilt angle being ensured.

As such, even if the bristle alignment direction 65D of the cleaning brush roller 65 is parallel to the axis of the cleaning brush roller 65, effects similar to those according to the configuration of the first embodiment can be achieved as long as the longitudinal direction of the flicker engaging portion 66*a* is not parallel to the axis of the cleaning brush roller 65 with a predetermined angle.

That is, instead of the configuration according to the first embodiment in which the bristle alignment direction 65D is tilted at a predetermined angle, in the second embodiment, with the bristle alignment direction 65D being parallel to the longitudinal direction of the roller axis, the straight-line outer edge of the upper end of the engaging portion 60*a* is tilted at an angle approximately equal to the tilt angle (helix angle) in the bristle alignment direction 65D with respect to the longitudinal direction of the roller axis. Therefore, effects similar to those described above can be obtained.

As described above, according to the cleaning device of the second embodiment, at least effects similar to those according to the configuration of the first embodiment can be obtained. On the other hand, only the modification of the engaging portion 66*a* of the flicker 66 in the manner described above is required. That is, all that is required is to modify the shape of the flicker 66, which is a fixed member. This is simple in configuration and can be achieved at low cost.

In particular, if the configuration of the second embodiment is applied to the existing cleaning device having a cleaning brush roller with the bristle alignment direction of the brush bristles being parallel to the roller axial longitudinal direction, the operation effects can be obtained. Therefore, a wide range of application can be achieved. That is, all that is required is to replace the parallel flicker in the existing cleaning device by a flicker with its flicker engaging portion being tilted. On the other hand, for example, a member with a predetermined tilt angle can be added to the parallel engaging portion.

Here, in the configuration of the second embodiment, the outer edge of the upper end of the flicker engaging portion is preferably formed in a stereoscopic curve, similarly to the direction of the bristles aligned on the segment of the circle in the first embodiment. That is, for example, starting from one end of the outer edge of the upper end in the roller longitudinal direction, for every predetermined length from the one end to the other end in the roller longitudinal direction, a circle on a section in a radial direction at each position defined by the length is set so as to have a radius obtained by subtracting the amount of engagement from the entire length of the brush bristle. Also, based on the tilt angle, a radial line is extended from the center of the circle having an angle increased from the angle at the starting point by an angle corresponding to the predetermined length. Then, a point of intersection between the circle and the radial line is set. Then, the set points are connected by a smooth curve to form an extremely-mild spiral curve, on which the outer edge of the upper end is to be positioned. However, if the operation effects can be obtained as appropriate, the outer edge of the upper end does not have to be formed in a stereoscopic curve.

As set forth hereinabove, according to an embodiment of the present invention, a flicking operation for removing (flicking) toner from the cleaning brush roller is performed not simultaneously over the entire area in the axial direction of the cleaning brush roller. Thus, vibrations occurring at the time of flicking can be mitigated without reducing flicking capability. Therefore, vibrations that would affect image quality are not propagated to the image carrier. As a result, image quality can be improved.

Moreover, the cleaning brush roller that contacts the flicker is rotated in a direction opposite to a rotating direction of the image carrier. The cleaning brush roller includes a loop brush roller. Thus, it is possible to improve the ability of scraping foreign substances, such as residual toner, off the surface of the image carrier. Besides, the flicking operation force of the loop brush is larger compared to that of a straight-bristle brush. Therefore, vibrations can be more effectively suppressed.

Furthermore, because vibrations at the time of flicking can be suppressed, banding indicative of variations in density can be prevented in a sub-scanning direction. Thus, it is possible to prevent banding in an image and improve image quality. In addition, cleaning ability is not deteriorated with the elapse of time. By using the process cartridge, the cleaning device can be easily attached to and removed from the image forming apparatus. This facilitates the maintenance of the image forming apparatus, and service can be improved.

The configuration of the first embodiment and the configuration of the second embodiment are not precluded from each other, but these two configurations can be applied simultaneously. That is, if the tilt angle with respect to the brush roller axis (brush-roller rotation center axis) required for suppressing vibrations at the time of flicking is uniquely defined in advance according to design predictions and actual-device tests, the value of the tilt angle may be divided into two, and one of the two-divided values may be assigned to the tilt angle in the bristle alignment direction in the cleaning brush roller with reference to the brush roller axis (brush-roller rotation center axis), whilst the other one of the values may assigned to the tilt angle of the outer edge of the upper end in the flicker engaging unit as a reversely-tilted angle. Therefore, in particular, according to the configuration in which predetermined tilt angles are set in a distributed manner for both of two members with reference to the brush roller axis, the setting range of the tilt angle can be widened, thereby increasing the range of design selection. That is, no restriction is made by conditions for either one of the member, and a combination of conditions for both members defines the limit in this configuration. Therefore, even if the required tilt angle is large under various conditions, such as the length of the brush bristles, stiffness thereof, brush-roller rotating velocity, and toner characteristic (an average toner particle diameter or roundness), such a tilt angle can be easily achieved.

Also, the cleaning device according to the first embodiment is based on the configuration of the cleaning brush roller. This is not meant to be restrictive. Alternatively, based on the configuration of a cleaning brush belt, the bristle alignment direction of the brush bristles on the cleaning brush belt may be tilted at a predetermined angle with respect to a belt advancing direction. Still alternatively, in the configuration of the cleaning brush belt, as in the cleaning device according to the second embodiment, with the bristle alignment direction of the brush bristles being set in a direction perpendicular to the belt advancing direction, the contact outer edge of the flicker engaging portion may be formed so as to have a predetermined tilt angle with respect to the belt advancing direction. Still alternatively, both of these configurations described above may be combined together.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device that cleans a surface of an image carrier, the cleaning device comprising:

a cleaning blade configured to contact a surface of the image carrier;

a lubricant applying roller that applies a lubricant to the surface of the image carrier;

a cleaning brush roller that removes residual toner from the surface of the image carrier; and a flicker that removes toner from the cleaning brush roller, and that performs a flicking operation corresponding to a part of an entire area in an axial direction of the cleaning brush roller at one time.

2. The cleaning device according to claim 1, wherein the cleaning brush roller includes cleaning bristles that are arranged not in parallel to the axial direction of the cleaning brush roller.

3. The cleaning device according to claim 2, wherein the flicker includes an engaging portion that engages the cleaning bristles, and a longitudinal direction of the engaging portion is not parallel to the axial direction of the cleaning brush roller.

4. The cleaning device according to claim 1, wherein the cleaning brush roller is configured to rotate in a direction opposite to a rotating direction of the image carrier.

5. The cleaning device according to claim 1, wherein the cleaning brush roller includes a loop brush.

6. A process cartridge that is detachably attached to an image forming apparatus, the process cartridge comprising:

the image carrier; and the cleaning device according to claim 1.

7. An image forming apparatus comprising the process cartridge according to claim 6.

8. An image forming apparatus comprising:

the image carrier; and the cleaning device according to claim 1.

* * * * *